US009016511B2

(12) United States Patent
Widitora et al.

(10) Patent No.: US 9,016,511 B2
(45) Date of Patent: Apr. 28, 2015

(54) HEATED CONTAINER

(75) Inventors: Alvin Widitora, Los Angeles, CA (US); Rowdy Holstine, Hartford, WI (US); Gerald James Baker, Wauwatosa, WI (US)

(73) Assignee: Silgan Containers LLC, Woodland Hills, CA (US)

( * ) Notice: Subject to any disclaimer, the term of this patent is extended or adjusted under 35 U.S.C. 154(b) by 312 days.

(21) Appl. No.: 13/035,745

(22) Filed: Feb. 25, 2011

(65) Prior Publication Data

US 2011/0240656 A1 Oct. 6, 2011

Related U.S. Application Data

(60) Provisional application No. 61/365,421, filed on Jul. 19, 2010, provisional application No. 61/425,850, filed on Dec. 22, 2010.

(51) Int. Cl.

| | |
|---|---|
| ***A47J 39/00*** | (2006.01) |
| ***A47J 41/00*** | (2006.01) |
| ***B65D 81/38*** | (2006.01) |
| ***B65D 88/74*** | (2006.01) |
| ***B65D 6/30*** | (2006.01) |
| ***B65D 6/40*** | (2006.01) |
| ***B65D 6/38*** | (2006.01) |
| ***B65D 17/50*** | (2006.01) |
| ***B65D 81/34*** | (2006.01) |
| ***F24J 1/00*** | (2006.01) |

(52) U.S. Cl.

CPC *B65D 88/74* (2013.01); *B65D 7/36* (2013.01); *B65D 7/40* (2013.01); *B65D 7/46* (2013.01); *B65D 17/502* (2013.01); *B65D 81/3484* (2013.01); *F24J 1/00* (2013.01)

(58) Field of Classification Search

CPC ..... A47J 36/28; F24J 1/00; B65D 81/3484; B65D 81/3222; B65D 51/2821

USPC ..... 220/592.13, 592.22, 592.23, 277; 126/263.01–263.1; 426/523, 109; 206/219, 204; 62/4

See application file for complete search history.

(56) References Cited

U.S. PATENT DOCUMENTS

| | | | | | |
|---|---|---|---|---|---|
| 2,579,405 | A | * | 12/1951 | Lev Sukacev | 126/263.01 |
| 3,079,911 | A | * | 3/1963 | Ryan et al. | 126/263.07 |
| 3,970,068 | A | * | 7/1976 | Sato | 126/263.08 |

(Continued)

FOREIGN PATENT DOCUMENTS

| | | | |
|---|---|---|---|
| JP | 61-193068 | U | 12/1986 |
| JP | 03-218715 | A | 9/1991 |

(Continued)

OTHER PUBLICATIONS

U.S. Appl. No. 29/385,514, filed Feb. 15, 2011, Baker et al.

(Continued)

*Primary Examiner* — Robert J Hicks
*Assistant Examiner* — Shawn M Braden
(74) *Attorney, Agent, or Firm* — Reinhart Boerner Van Deuren s.c.

(57) ABSTRACT

A temperature changing container includes a plurality of walls joined to form an enclosure which seals contents of the enclosure within the walls. One of the walls includes a depression extending into the enclosure. Upon activation, chemicals at least partially disposed within the depression change temperature.

21 Claims, 37 Drawing Sheets

(56) References Cited

U.S. PATENT DOCUMENTS

| | | | | |
|---|---|---|---|---|
| 4,640,264 | A | 2/1987 | Yamaguchi et al. | |
| 4,741,324 | A * | 5/1988 | Ina et al. | 126/263.06 |
| 4,819,612 | A * | 4/1989 | Okamoto et al. | 126/263.01 |
| 5,088,870 | A | 2/1992 | Fukuhara et al. | |
| 5,255,812 | A * | 10/1993 | Hsu | 220/277 |
| 5,388,565 | A * | 2/1995 | Ou | 126/263.08 |
| 5,542,418 | A | 8/1996 | James | |
| 6,338,252 | B1 | 1/2002 | Calderaio | |
| 6,962,149 | B2 | 11/2005 | Kolb | |
| 6,986,345 | B2 * | 1/2006 | Kolb | 126/263.08 |
| 7,350,361 | B2 | 4/2008 | Maxwell et al. | |
| 7,350,362 | B2 | 4/2008 | Danwoody | |
| 8,360,048 | B2 * | 1/2013 | Ford et al. | 126/263.08 |
| 2002/0117163 | A1 * | 8/2002 | Searle | 126/263.01 |
| 2002/0144676 | A1 * | 10/2002 | Bouskila | 126/262 |
| 2006/0118103 | A1 | 6/2006 | Schreff et al. | |
| 2006/0132344 | A1 * | 6/2006 | Ishii et al. | 341/144 |
| 2008/0302799 | A1 | 12/2008 | Moore et al. | |
| 2010/0025279 | A1 | 2/2010 | Baker et al. | |
| 2010/0025281 | A1 | 2/2010 | Baker et al. | |
| 2010/0252022 | A1 * | 10/2010 | Coffey et al. | 126/263.01 |
| 2011/0011868 | A1 | 1/2011 | Manne et al. | |
| 2013/0105493 | A1 | 5/2013 | Widitora et al. | |

FOREIGN PATENT DOCUMENTS

| | | | |
|---|---|---|---|
| JP | 2002-544072 | A | 12/2002 |
| WO | WO 03-097481 | A1 | 11/2003 |

OTHER PUBLICATIONS

U.S. Appl. No. 13/023,990, filed Feb. 9, 2011, Moore et al.

U.S. Appl. No. 13/050,446, filed Mar. 17, 2011, Manne et al.

U.S. Appl. No. 13/358,259, filed Jan. 25, 2012, Baker et al.

International Search Report and Written Opinion for International Application No. PCT/US2011/043886, mail date Feb. 28, 2012, 13 pages.

* cited by examiner

HEATED CONTAINER

CROSS REFERENCE TO RELATED APPLICATIONS

This patent application claims the benefit of U.S. Provisional Patent Application No. 61/365,421, entitled Self Heating Container, filed Jul. 19, 2010, and U.S. Provisional Patent Application No. 61/425,850, entitled Self Heating Container, filed Dec. 22, 2010, both incorporated in their entirety herein by reference.

BACKGROUND

The present invention relates to the field of containers, and, in particular, relates to a self-heating container.

SUMMARY

A self-heating container is provided which includes a cylindrical metal side wall, a top can end joined to the metal side wall with a joint, and a metal, bottom can end joined to the metal side wall to form an enclosure having an interior, the metal bottom can end including a depression extending into the interior. The container also includes a heating element having a canister located at least partially within the depression. The canister has chemicals hermetically sealed therein and an activation structure for permitting the user to cause the chemicals to react and increase the temperature of the interior of the container.

A temperature changing container is also provided which includes a plurality of walls joined to form an enclosure which hermetically seals the contents of the enclosure within the walls, wherein one of the walls includes a depression extending into the contents of the enclosure. The container also includes a temperature changing element having a canister located at least partially within the depression. The canister has chemicals hermetically sealed therein and an activation structure for permitting the user to cause the chemicals to change state to change the temperature of the element.

By way of further exemplary configurations, a container is provided which includes a plurality of walls joined to form an enclosure which hermetically seals the contents of the enclosure within the walls, wherein one of the walls includes a depression extending into the contents of the enclosure. A heating element is provided which includes a canister located at least partially within the depression. The canister has chemicals hermetically sealed therein and an activation structure for permitting the user to cause the chemicals to change state to change the temperature of the heating element.

A self-heating container is provided including a cylindrical metal side wall defining an interior, a top, can end hermetically joined to the metal side wall, and a metal bottom, can end joined to the metal side wall to form an enclosure having an interior. The metal bottom, can end includes a depression extending into the interior. The self-heating container also includes a double-seam which hermetically joins the side wall to the bottom, can end to orient the depression to extend into the interior. The self-heating container further includes chemicals which are formulated to generate heat when activated and a metal closure panel joined to the bottom, can end to create an enclosure for the chemicals hermetically separated by the bottom, can end from the interior.

A temperature changing container is also provided which includes a plurality of walls joined to form an enclosure which hermetically seals the contents of the enclosure within the walls, wherein one of the walls includes a depression extending into the contents of the enclosure. The container also includes chemicals which are formulated to change state and change the temperature of the container when activated and a closure panel joined to the enclosure to encapsulate the chemicals within the depression between the enclosure and the panel.

By way of further exemplary configurations, a self-heating container is provided which includes a cylindrical metal side wall defining an interior, a metal, bottom, can end joined to the metal side wall to form an enclosure having an interior and including a depression extending into the interior. The self-heating container also includes a double-seam formed from the side wall and the can end to hermetically join the side wall to the can end to orient the depression to extend into the interior. The container also includes chemicals which are formulated to change temperature when activated, and a metal closure panel joined to the bottom, can end to create an enclosure for the chemicals hermetically separated by the bottom, can end from the interior.

DETAILED DESCRIPTION

Figure 1:
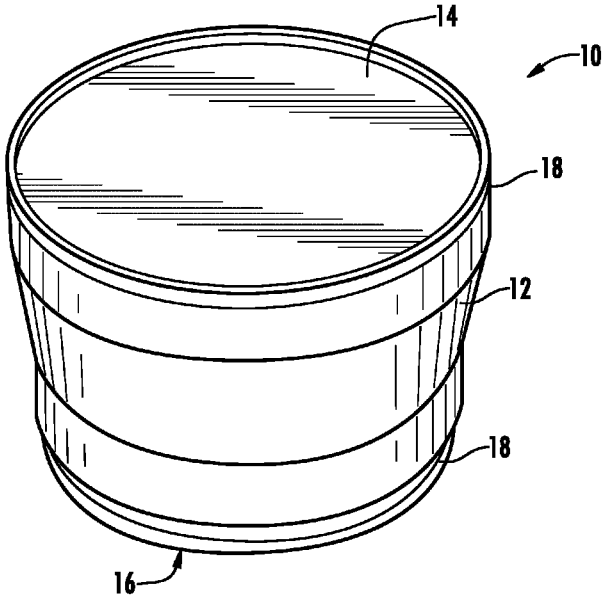
FIG. 1 is a top, perspective view of a container according to an exemplary embodiment.

Referring to FIG. 1, a container 10 is shown which includes a side wall 12, a top 14 and a bottom 16. Containers of this type may include a shaped side wall (as shown by example), a separately formed bottom can end (or bottom end wall), and a separately formed top can end (or top end wall). Containers of this type may also be unitarily formed with a side wall and one or both can ends. For uses which may have a metal (e.g. steel, coated steel, etc.) can such as coffee, coffee-type drinks, tea, hot chocolate, soups, noodle dishes, tuna, tomatoes, etc., the can ends 14,16 may be fabricated all, or in part, from a metal, and are joined to the side wall 12 with a rolled joint or soldered joint 18 (i.e., double seam). In other applications one or both of the can ends 14, 16 may be joined to the side wall by being integrally formed with the side wall 12. By way of further example, the side wall 12 and one or both of the can ends 14, 16 may be formed from a non-metallic material, such as a plastic. The side wall 12 and one or both can ends 14, 16 may also be formed of mixed materials, with each being formed from a different metal, with one being steel and the others being aluminum or plastic, or any suitable combination of materials known in the art.

Figure 41:
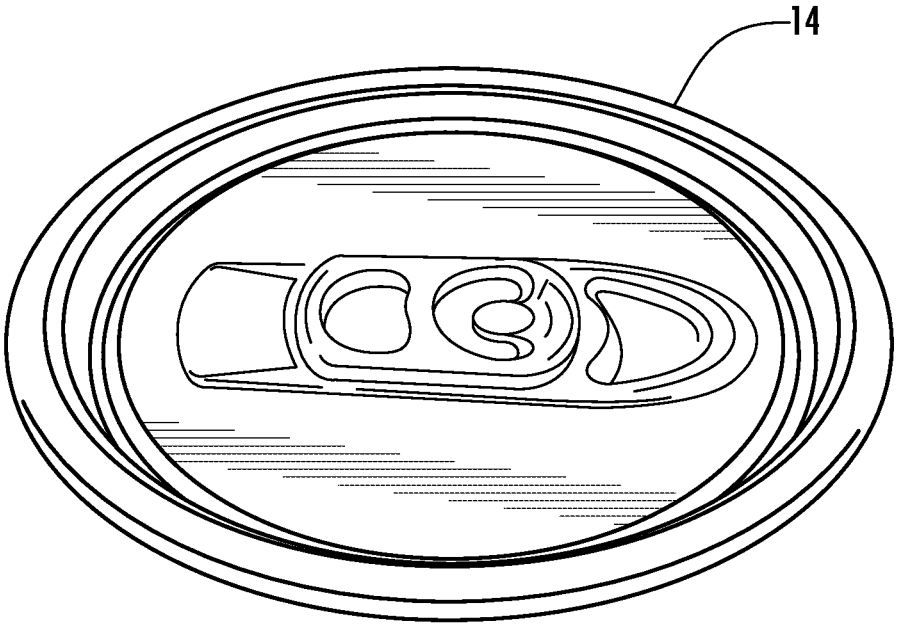
FIG. 41 illustrates a perspective view of an embodiment of a can end including a stay on tab.

Examples of the top can end 14, or the end which a user opens, are pull top ends, standard ends (can opener required), peel back foil opening ends, and screw top ends. For uses, for example, such as a container for coffee, tea, hot chocolate, or coffee-type drinks, stay on tab ends, and other easy-opening tops known in the art may be used. An exemplary stay on tab end is illustrated in FIG. 41.

Figure 2:
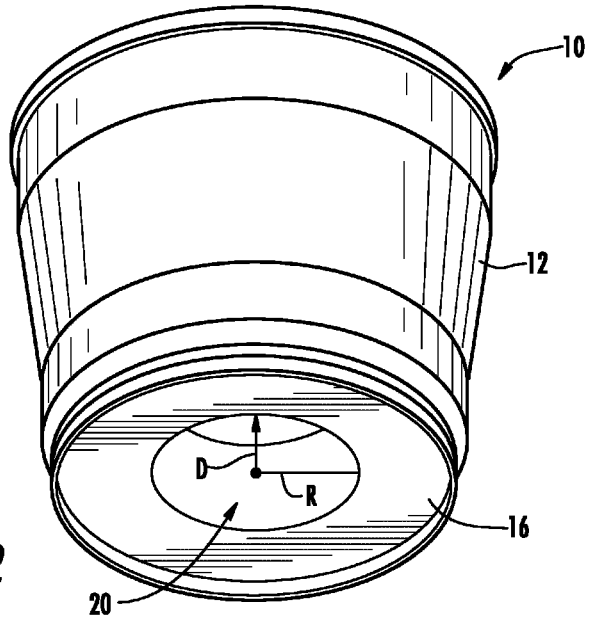
FIG. 2 is a bottom, perspective view of the container.

Referring to FIG. 2, in one embodiment the container 10 is shown with a depression 20 in the bottom can end 16. This depression 20 is cylindrical and has a depth D, a radius R, and a radius r (illustrated in FIG. 7 and discussed further below). However, the size and shape of the depression 20 is variable and selected in part based upon the heating unit 22 (illustrated in FIG. 5) to be selected for use with the container 10. In certain embodiments the depression 20 may be domed, tapered, tapered cylindrical, cubed, frustoconical, or any other suitable shape. Factors which affect the selection of the heating unit 22 include volume of the container 10, type of material (e.g. food contained by the container 10), desired temperature of the container 10, heating speed, heat transfer characteristics of the container 10 and contents, accessibility to food in the container 10, etc. Preferably the ratio of the depth D of the depression 20 to the radius R is no more than fifty percent (the depth D being less than half as large as the radius R).

Figure 3:
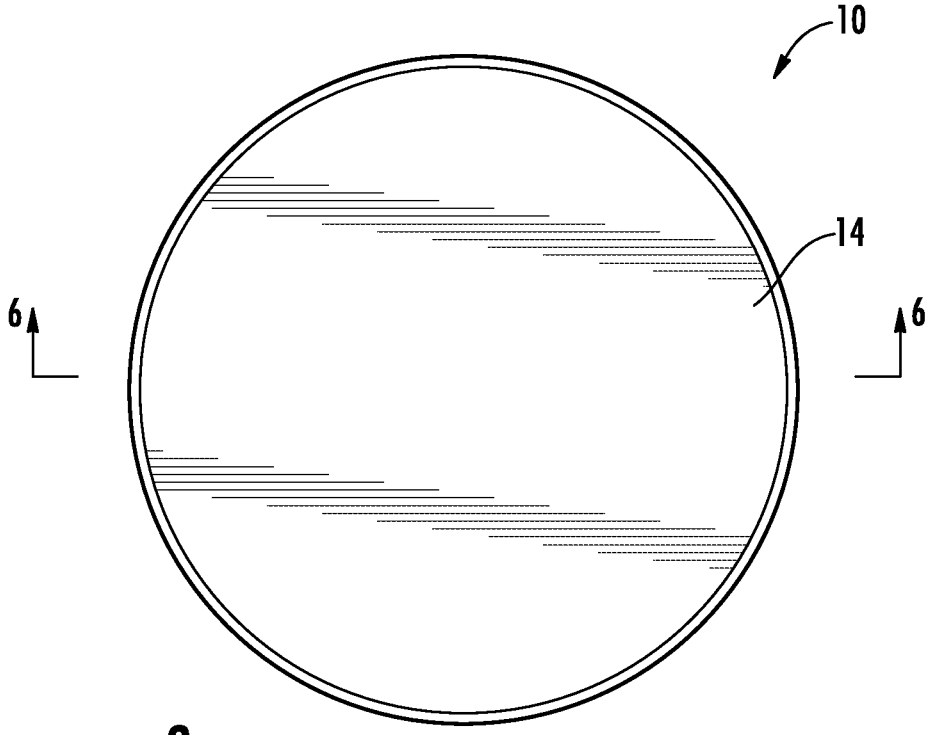
FIG. 3 is a top view of the container.
Figure 4:
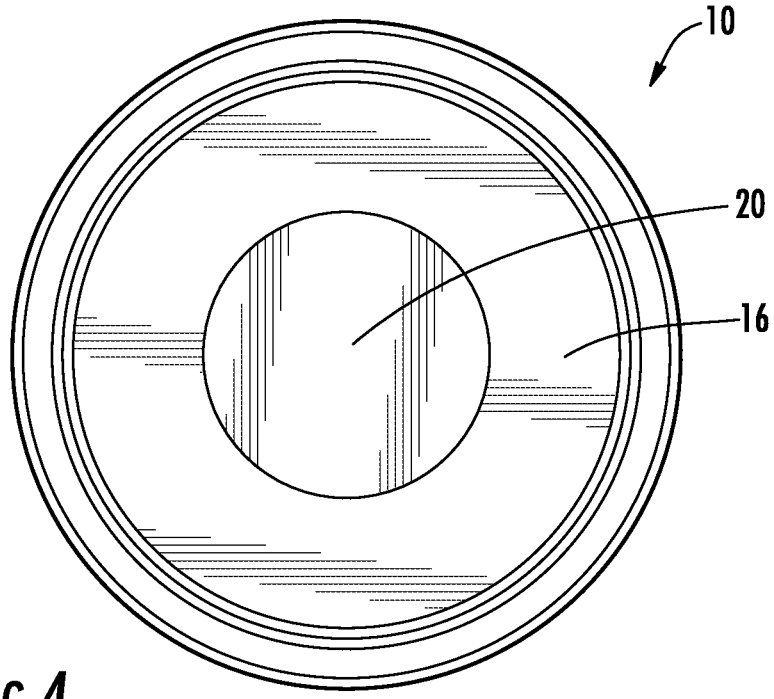
FIG. 4 is a bottom view of the container.

Referring to FIGS. 3 and 4, the container 10 is shown from the top and bottom. The top of the depression 20 in the bottom is shown and this creates a "moat" within which content is located in the container 10. As discussed above, for some uses of the container, accessibility to the content such as food is important. Accordingly, when, for example a spoon is used, it is desirable to use a shallow moat and corresponding heating unit 22.

Figure 5:
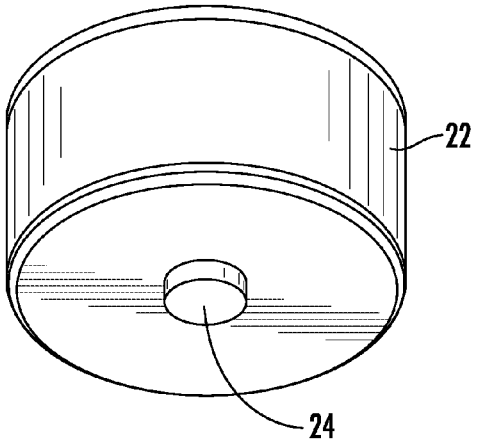
FIG. 5 is a perspective view of a heating unit.

Referring to FIG. 5, a stand-alone heating unit 22 is shown as a metal cylinder which includes chemical content for generating heat upon activation with a button 24 or shaking motion. In embodiments of the heating unit 22 activated by a shaking motion, the button 24 may be omitted. Examples of chemicals used for this purpose are a magnesium and water combination, and a calcium oxide and water combination. Other suitable chemicals are contemplated. In the present embodiment the heating unit 22 is shown as stand alone. However, it is also contemplated that the chemicals of the heating unit 22 could be placed in the depression 20 and covered with a suitable cover. This configuration would be used with a can end 16 which is manufactured with the heating chemicals contained in the can end 16 without the need for a separate heating unit 22.

Figure 6:
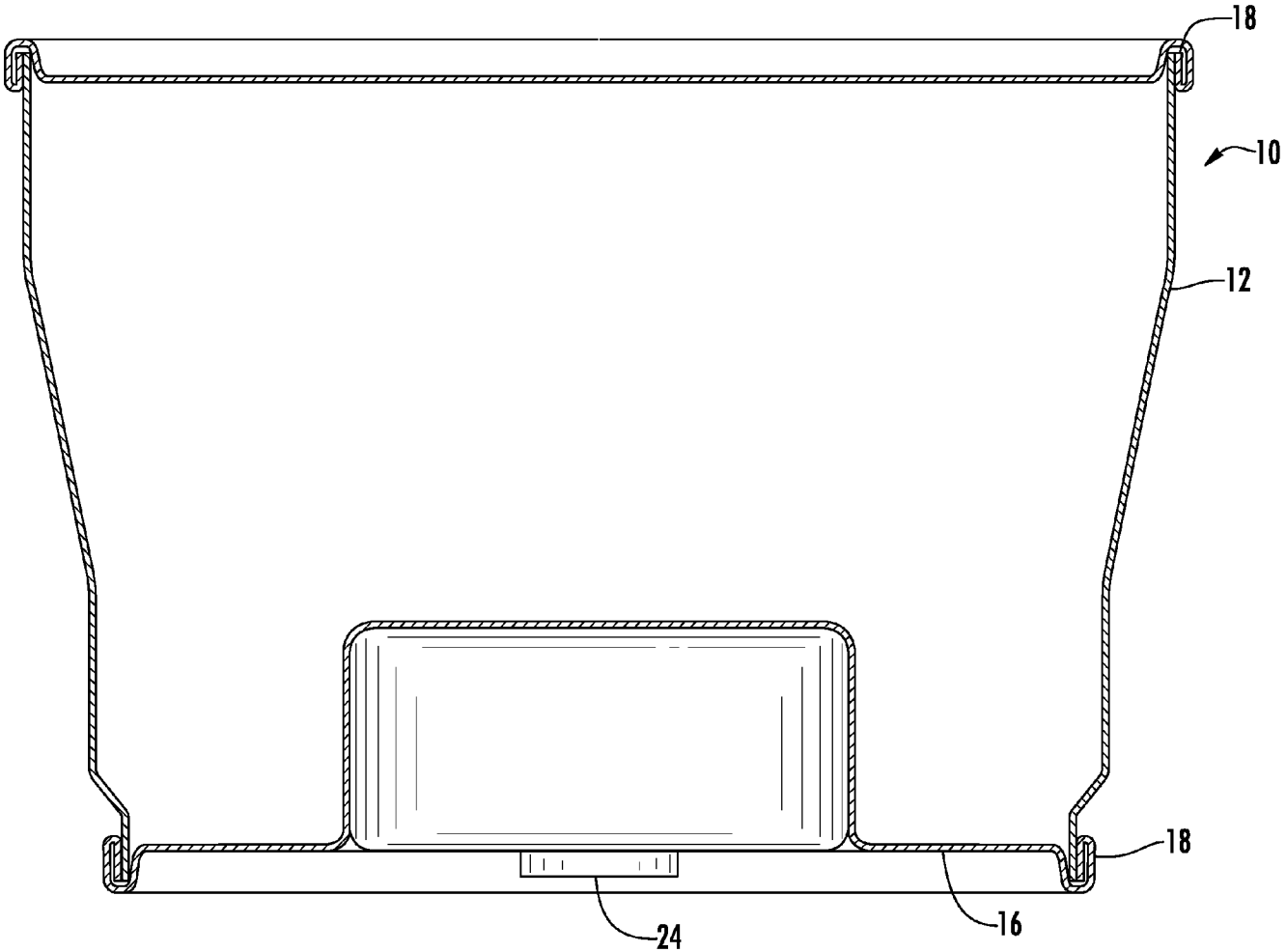
FIG. 6 is a sectional view of the container taken along 6-6 in FIG. 3 which shows the heating element located relative to the container.

Referring to FIG. 6, the container 10 is shown in combination with the heating unit 22. In certain embodiments the bottom of the heating unit 22 may include an insulation layer extending over a portion or all of the bottom of the heating unit 22. In embodiments of the heating unit 22 including the button 24, the insulation layer may also cover the button 24 or may only cover the portions of the bottom of the heating unit 22 surrounding the button 24.

Additionally, in certain embodiments, the can end 16 may also include an insulation layer. This insulation layer may be integrally formed with or may be coupled to a portion or all of the can end 16. This insulation layer may cover all or a portion of the heating unit 22, including the button 24.

Each of the insulation layers may be used alone in certain embodiments or may be used in combination with one another. The insulation layers may be made of any suitable insulator known in the art. The insulation layer of the heating unit 22 may be formed from the same or a different type of insulating material than the insulating layer of the can end 16

Figure 7:
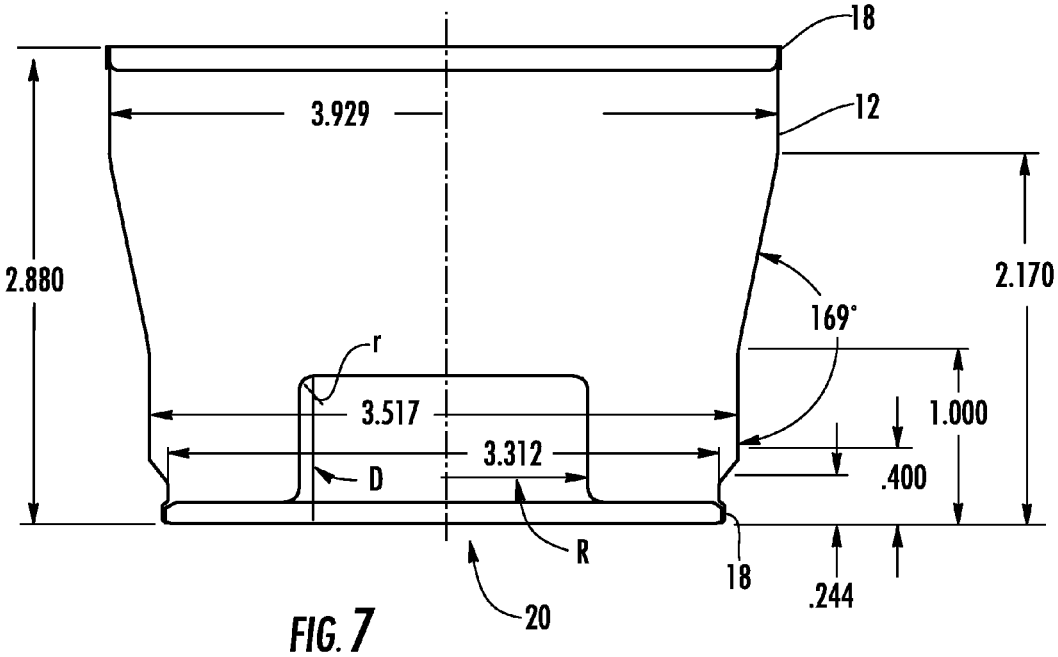
FIG. 7 is a sectional view of the container taken along 6-6 in FIG. 3 which shows dimensions for one example of a self-heated container.

The dimensions for an example of the container 10 which would likely be used with soup or a noodle dish are shown in FIG. 7. This container has a metal side wall 12, and metal ends 14, 16. The depression 20 also has a small radius r. Containers 10 of various shapes with various radii r suitable for various applications are envisioned. Exemplary dimensions are illustrated in inches. Exemplary dimensions of the radius R and depth D of the depression 20 may be between approximately 0.75 inches and 1.5 inches in radius R and 0.3 inches and 1.0 inch in depth D, and in one embodiment approximately 1.0 inch in radius R and 0.6 inches in depth D. Exemplary volumes of the depression 20 are between approximately 0.5 inches and approximately 7.0 cubic inches, and in one embodiment approximately 1.9 cubic inches. Other exemplary dimensions as would be recognized by one having ordinary skill in the art are also contemplated.

Referring to FIGS. 8A-12A, there is shown the progression of the formation of a can end 16 which is configured to include a heating unit 22. This can end 16 is useable in the configuration of the container 10 discussed in reference to FIG. 1 which includes a can end 16 which is joined to the side wall 12 with a rolled or soldered joint 18. This type of can end 16 is formed from metal (e.g. steel or 0.0082 aluminum) using a progressive drawing or stampling process.

Figure 8A:
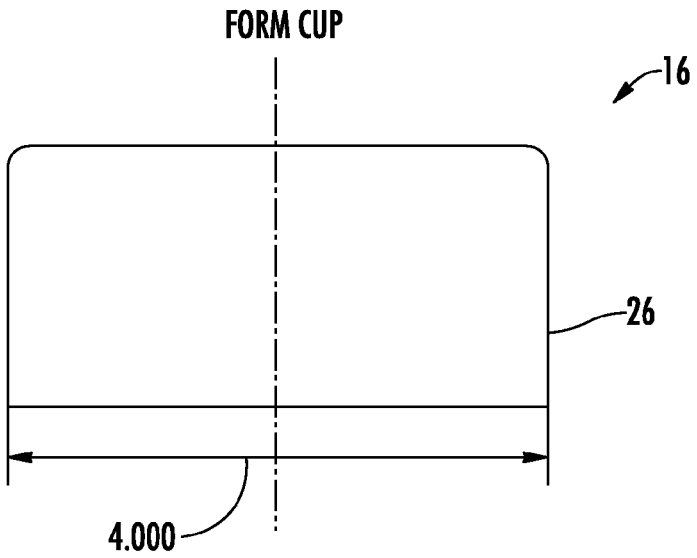
FIGS. 8A-12B are views of the progression of the formation of a can end which is configured to accept a heating element.
Figure 8B:
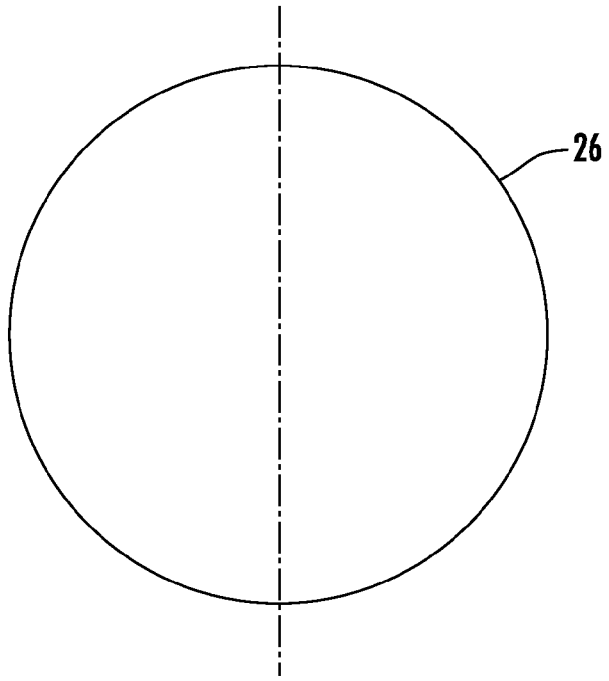
Figure 9A:
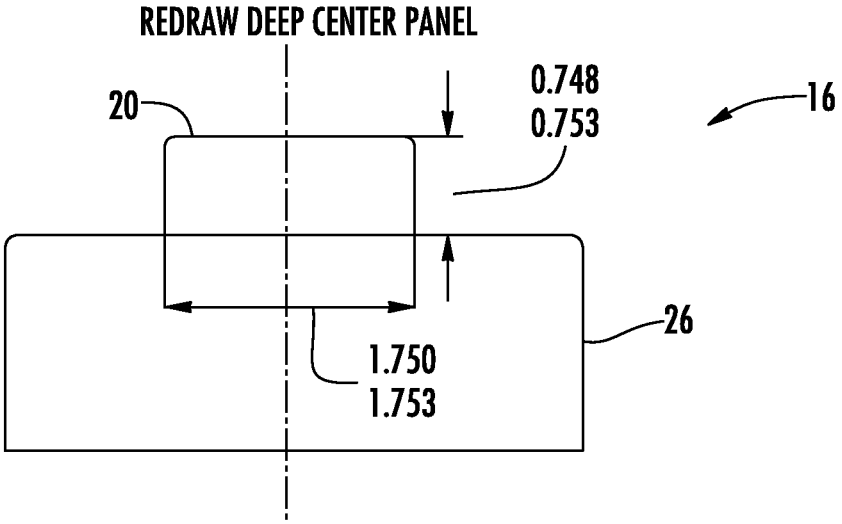
Figure 9B:
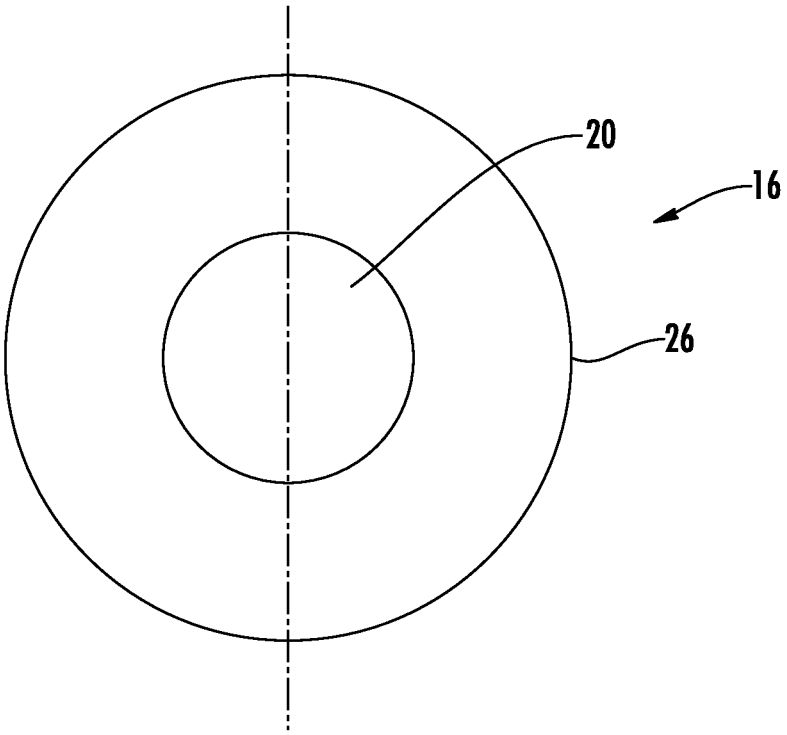
Figure 10A:
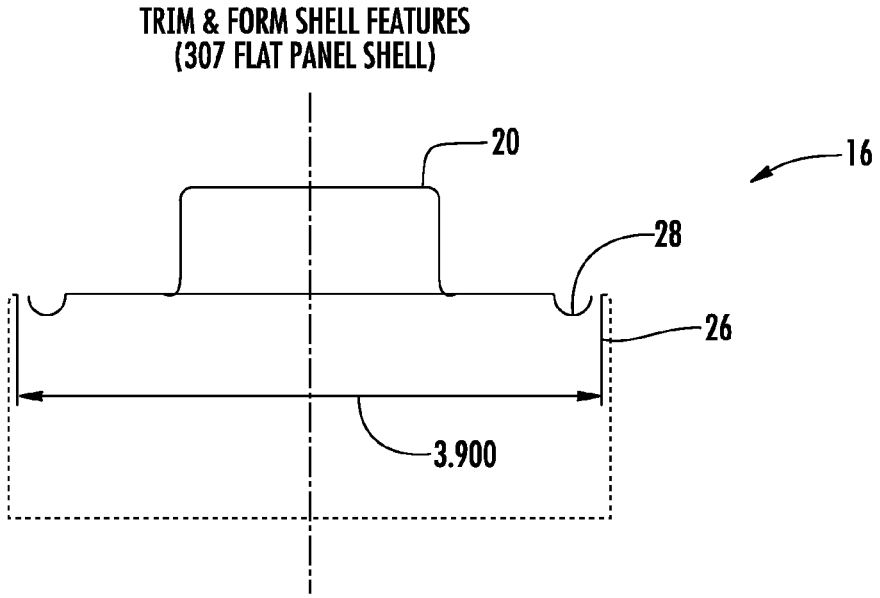
Figure 10B:
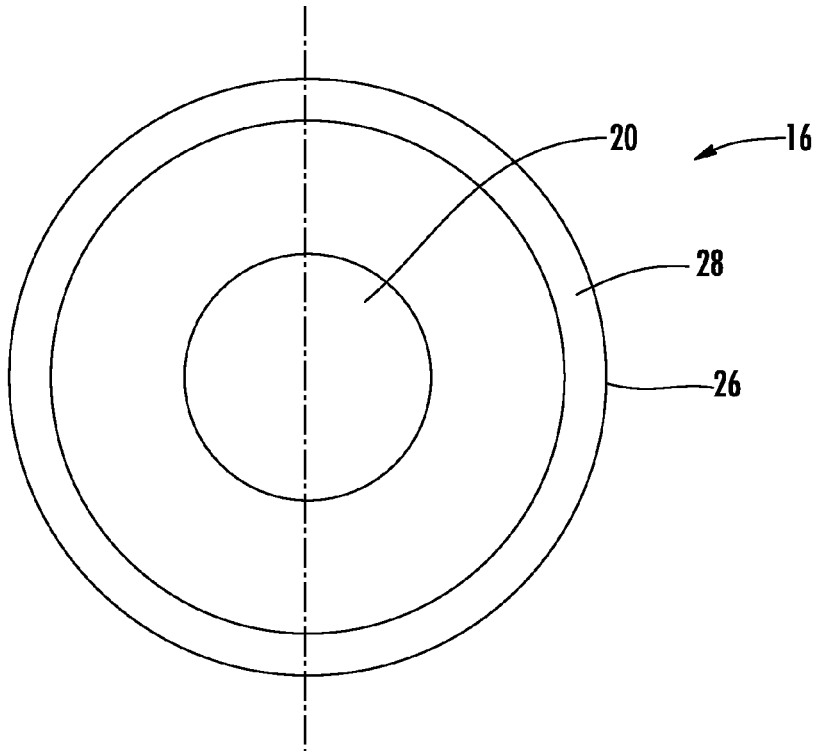

The first main step of the process is to provide a metal blank which is drawn or stamped to form a cup 26 as shown in FIGS. 8A, 8B. The second main step of the process includes redrawing the cup of FIG. 8A to include a depression 20 as shown in FIGS. 9A, 9B. This depression 20 provides the location or storage site for the heating unit 22 in the can end 16. The third main step of the process is to trim the cup 26 and form the flange 28 as shown in FIGS. 10A, 10B. The flange 28 is formed for use in creating a sealed joint 18 with the side wall 12 of the container 20.

Figure 11A:
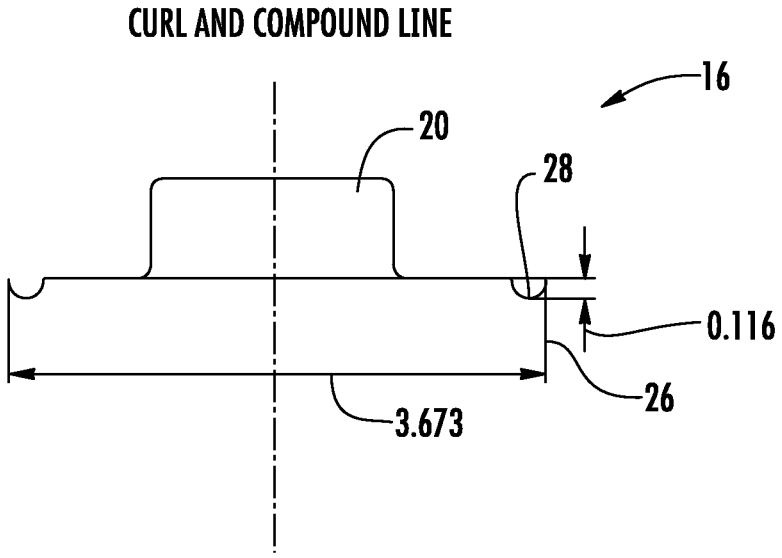
Figure 11B:
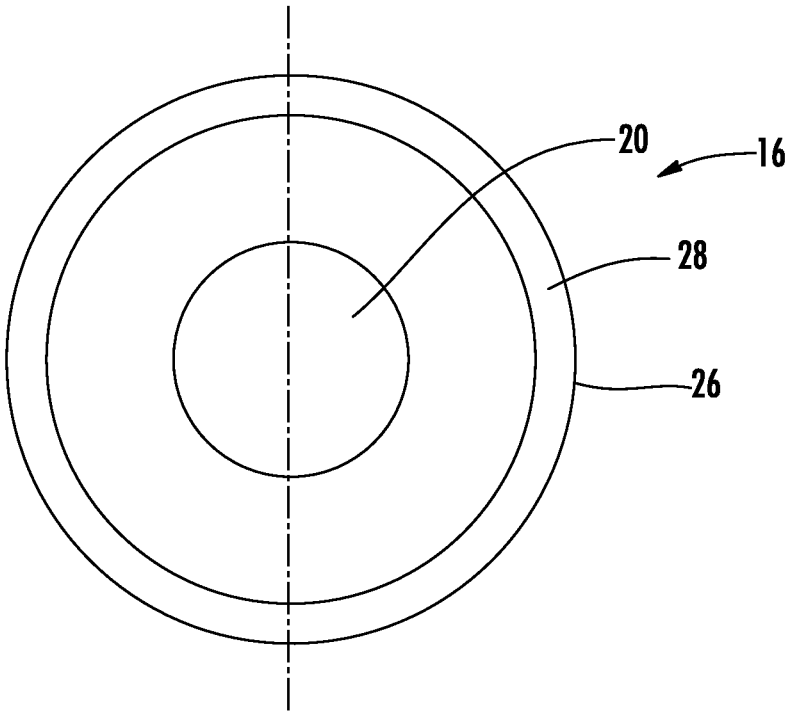
Figure 12A:
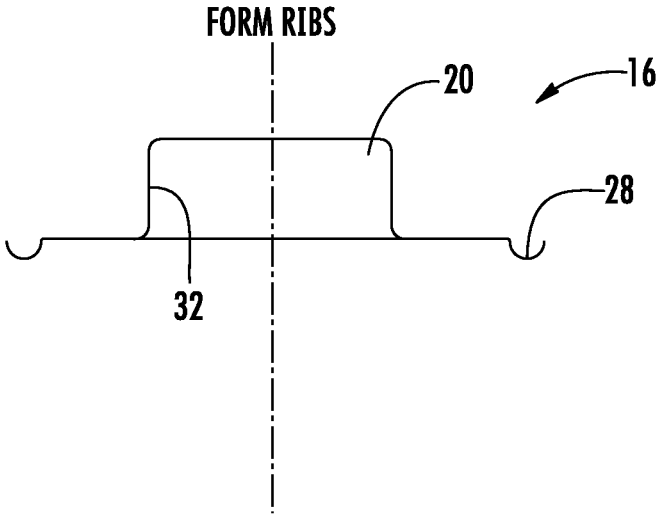
Figure 12B:
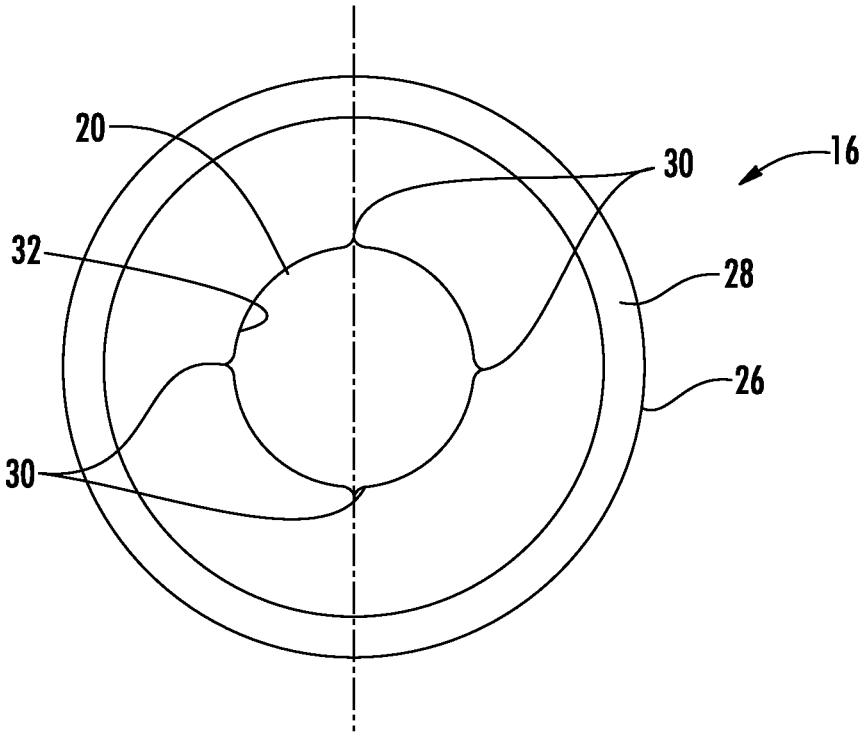

The fourth main step in forming the can end 16 includes further configuration (e.g. curling) of the flange 28 and applying a sealant or gasket to the top side of the curled flange 28 area as shown in FIGS. 11A, 11B. The sealant or gasket provides a hermetic seal between the corresponding container side wall 12 when the can end 16 and side wall 12 are joined with a rolling process to form a rolled joint 18. For applications which use or require a soldered can joint 18, the flange 28 would be configured to optimize the soldering process. To further configure the depression 20 to accommodate, contain and hold a heating element 22, either inward or outward extending ribs or ridges 30 may be formed in the depression 20 as shown in FIGS. 12A, 12B. These ridges 30 serve to provide an interference fit between the heating element 22 and the depression 20 to hold the heating element 22 within the depression 20. Where the ridges 30 extend inward into the interior of the depression 20, the ridges 30 provide interference with the heating element 22 to form a friction type fit to hold the element 22 in the depression 20. Where the ridges 30 extend outward from the interior of the depression 20, the ridges 30 provide resilience in the wall 32 of the depression 20 which permits the 4 portions of wall 32 to interference with the heating element 22 to also form a friction type fit to hold the element 22 in the depression 20. In both exemplary configurations, the ridges 30 may serve to allow air to escape from the depression 20 as the heating element 22 is urged into the depression 20, allowing easy insertion of the heating element 22 into the depression 20 in addition to allowing an interference friction type fit.

Referring to FIG. 13-40, another embodiment of the top can end and the side wall is illustrated. These Figures are described in further detail below. Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 15:
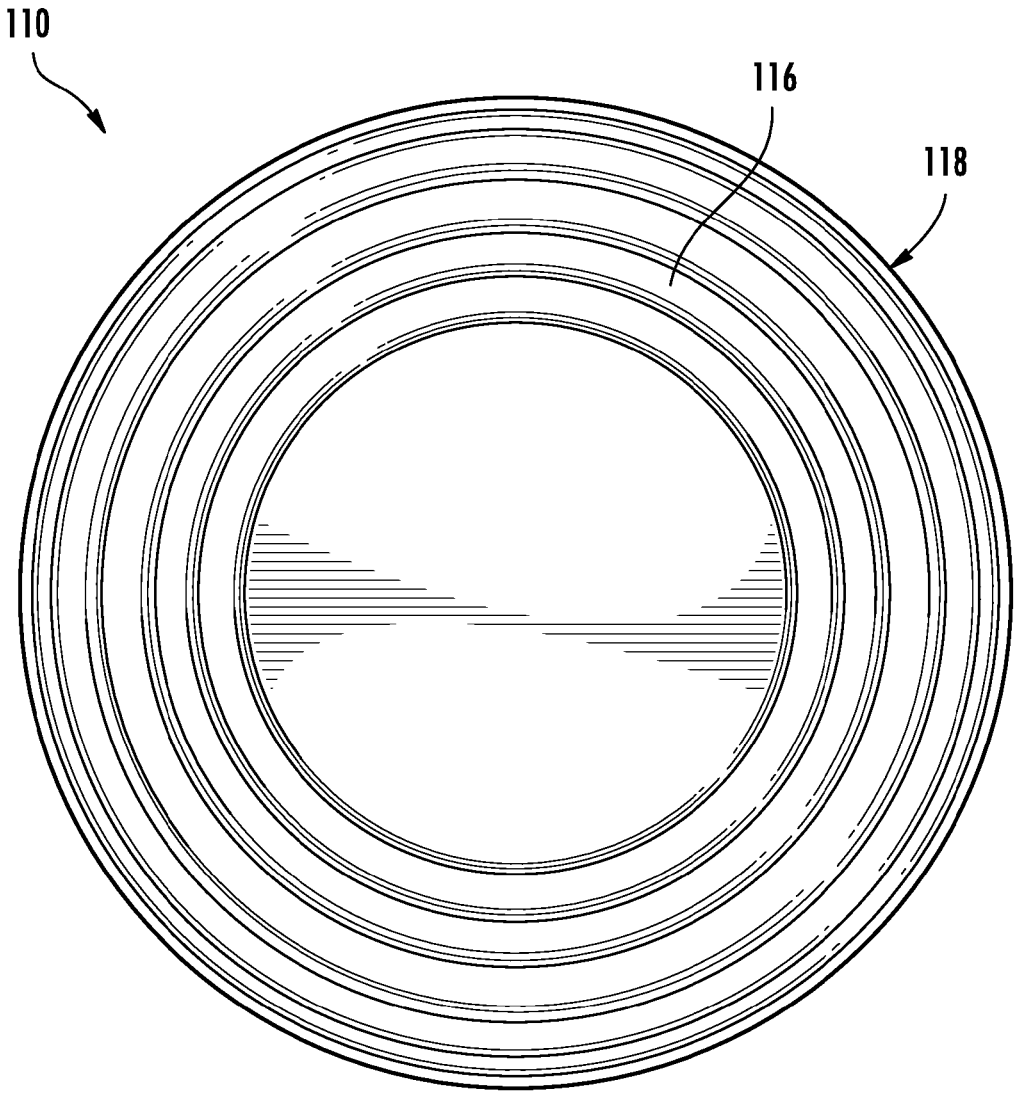
Figure 16:
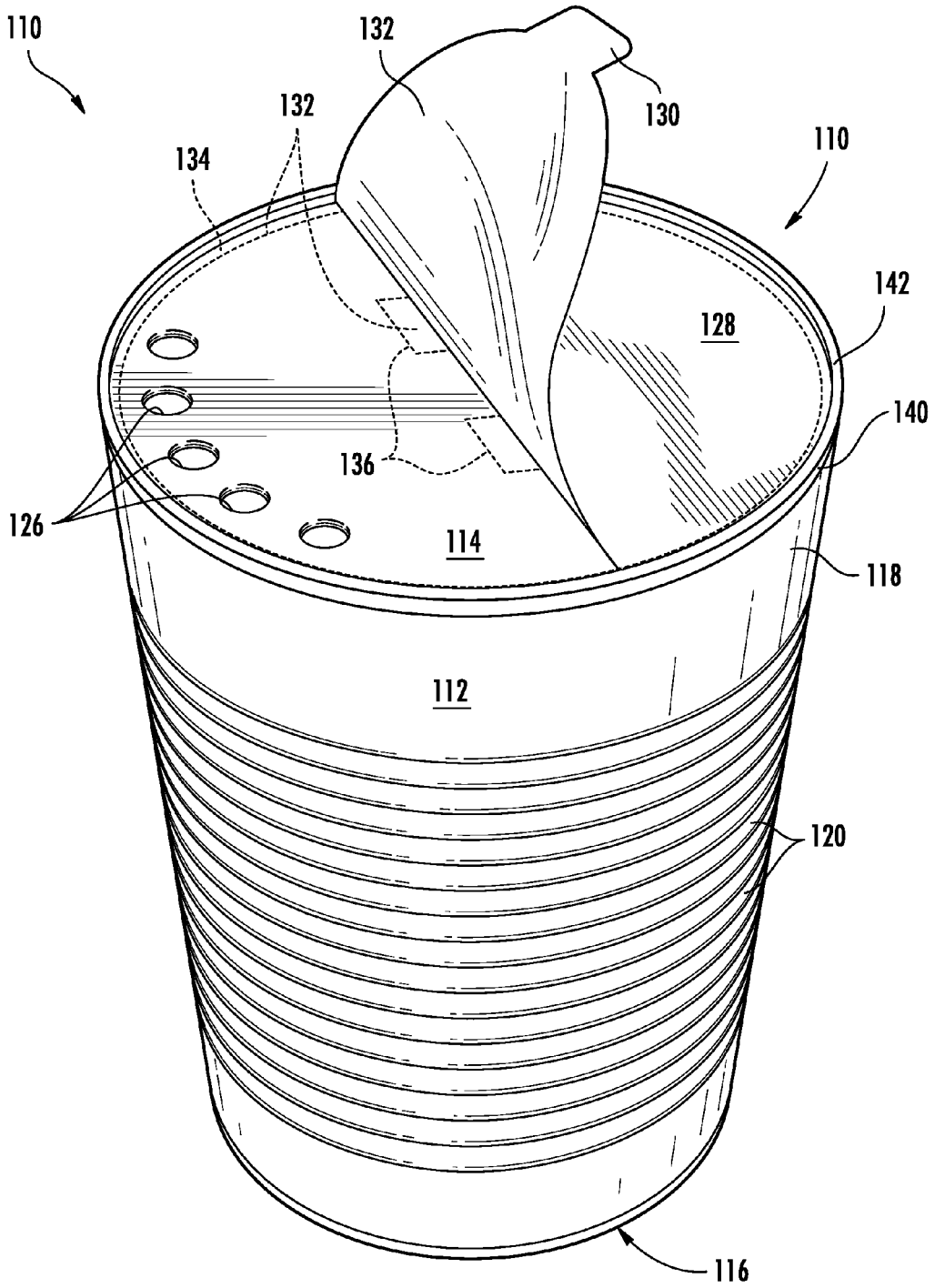
Figure 17:
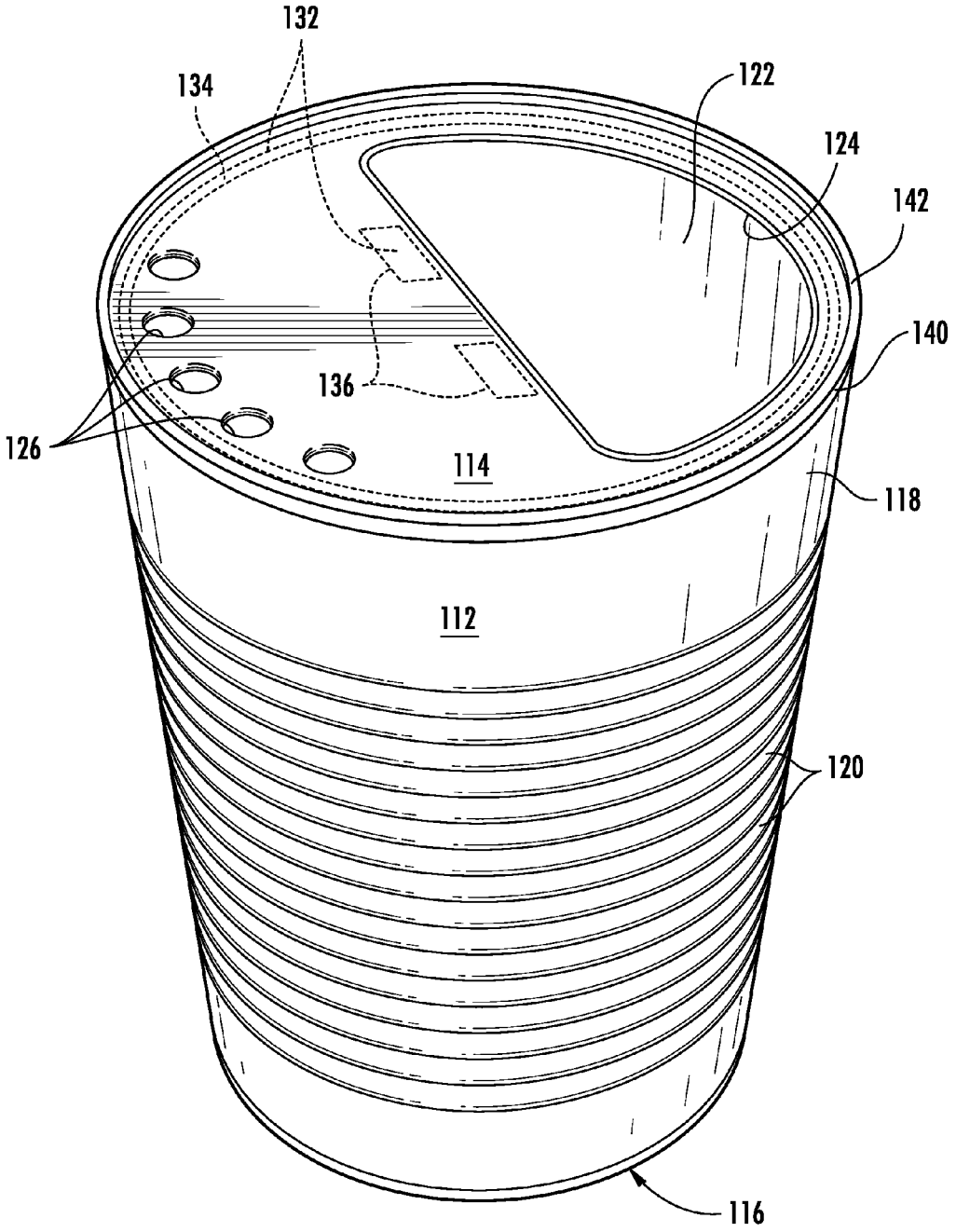
Figure 26:
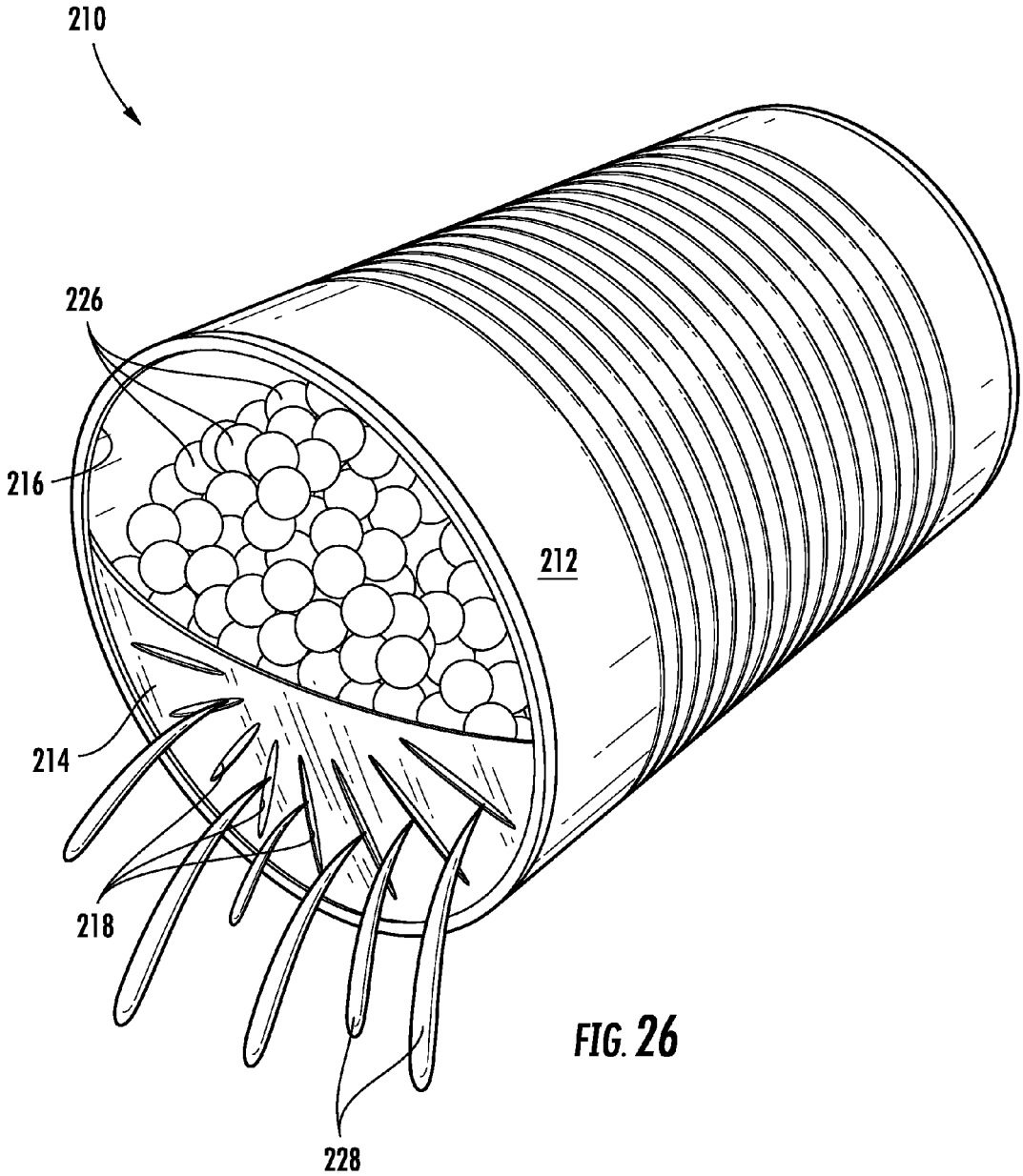
Figure 27:
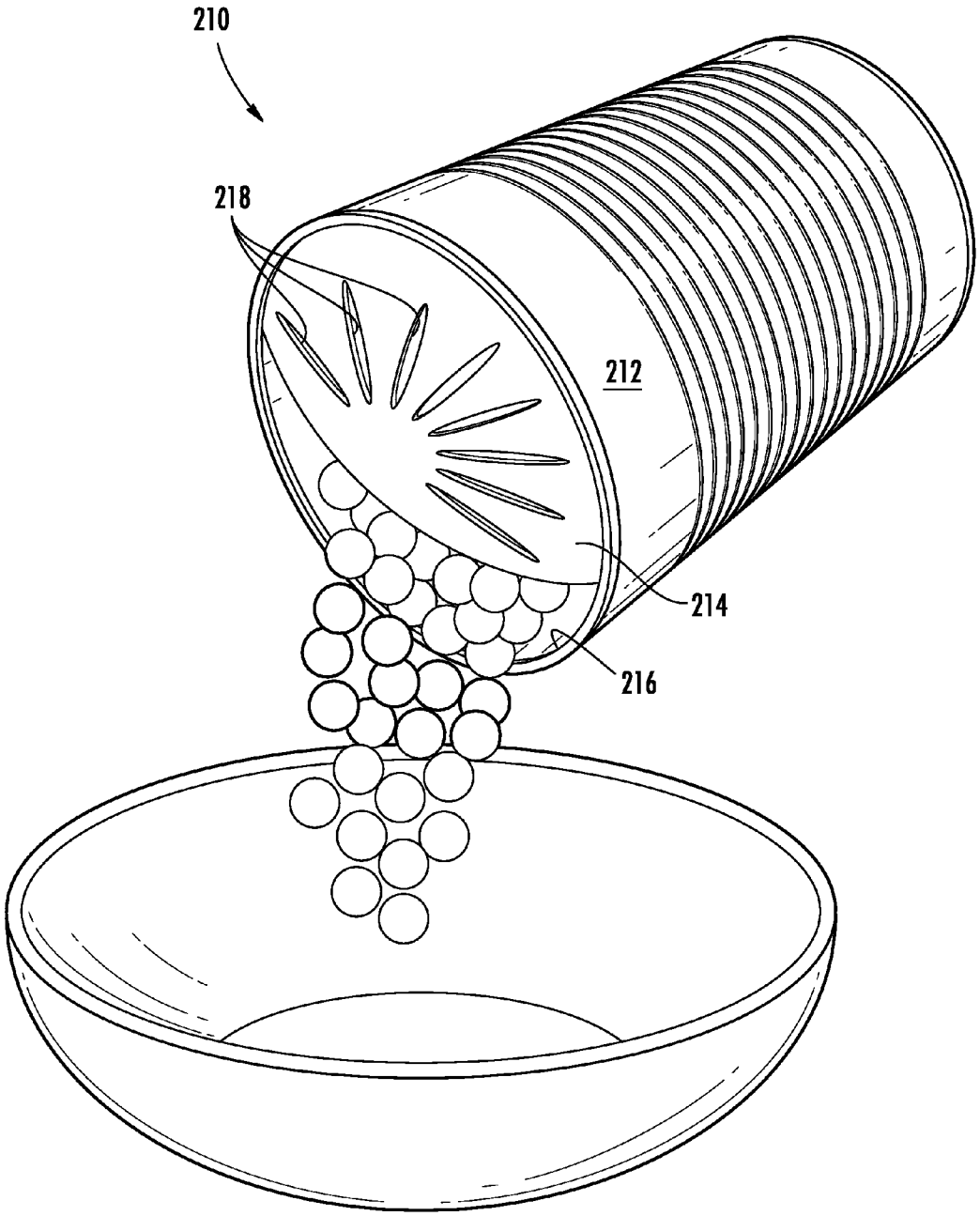

Referring to FIGS. 13-17, a container assembly 110 includes a can 112 (e.g., can body) and a can end 114 (e.g., top) (FIG. 17). The can 112 includes a bottom 116 (FIG. 18) (e.g., second can end) and sides 118 (FIG. 14) extending vertically from the bottom 116. In some embodiments, the sides 118 form a cylindrical tube and include ridges 120. The can 112 defines a volume 122 (see FIG. 17) internal thereto, in which contents (see, e.g., solid items 226 and liquid 228 as shown in FIG. 26), such as cut fruit suspended in syrup or beans in water, of the container assembly 110 may be stored. A label (not shown) may be printed and/or adhered to the sides 118 of the can 112, identifying the contents of the container assembly 110.

Figure 33:
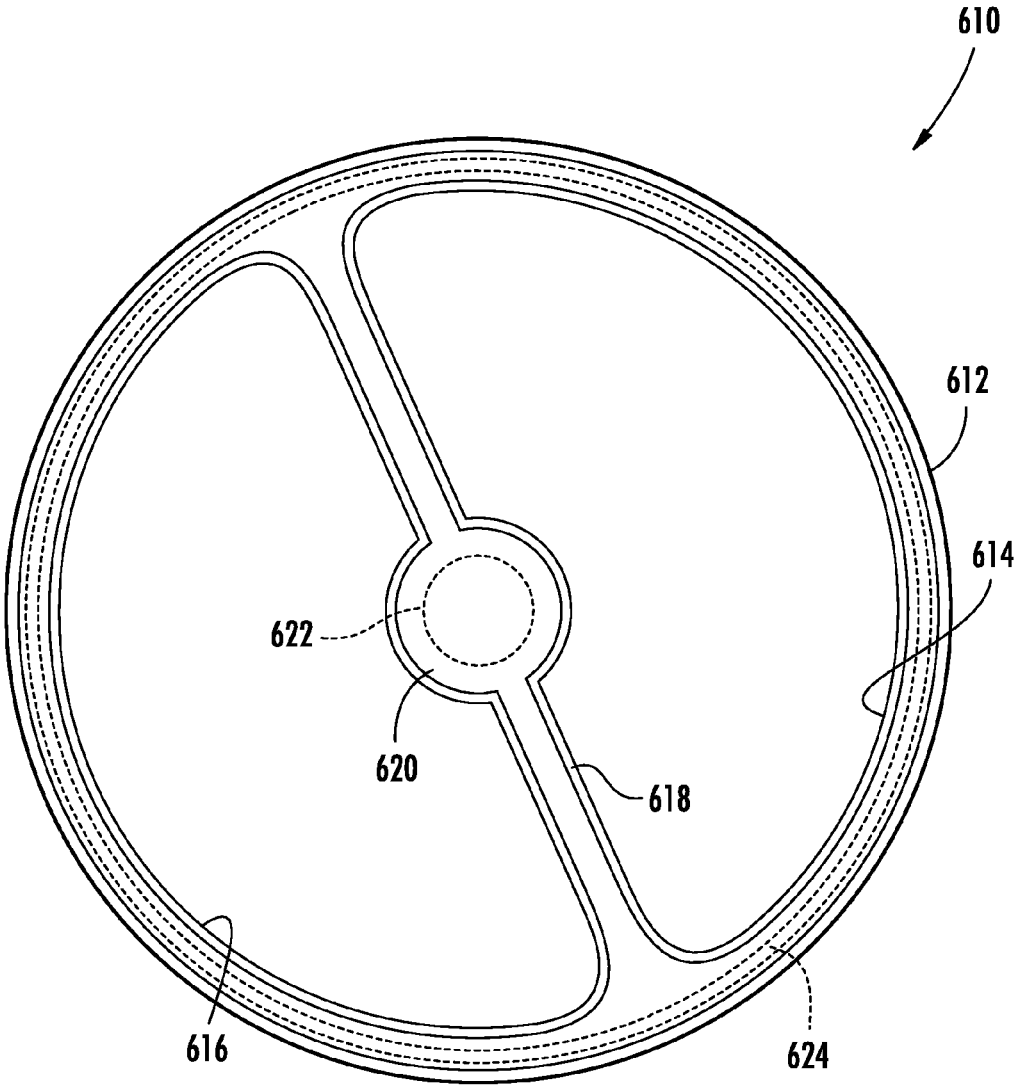

The can end 114 includes a first opening 124 (e.g., large opening, hole, aperture, etc.) and one or more second openings 126 (e.g., a plurality of small openings). The first opening 124 is wide enough to pour solid contents of the container assembly 110 therethrough. In some embodiments, the first opening 124 has an area that is slightly less than half the area of the can end 114, and is formed in a crescent shape, a half-circle, or otherwise shaped. Each second opening 126 is sized for straining, such that the solid contents of the container assembly 110 are generally too large to fit therethrough. In some embodiments, each second opening 126 is less than one fifth the size of the first opening 124, such as less than one tenth the size of the first opening 124. However, in other embodiments the first and second openings are the same size (see, e.g., openings 614, 616 as shown in FIG. 33).

Figure 13:
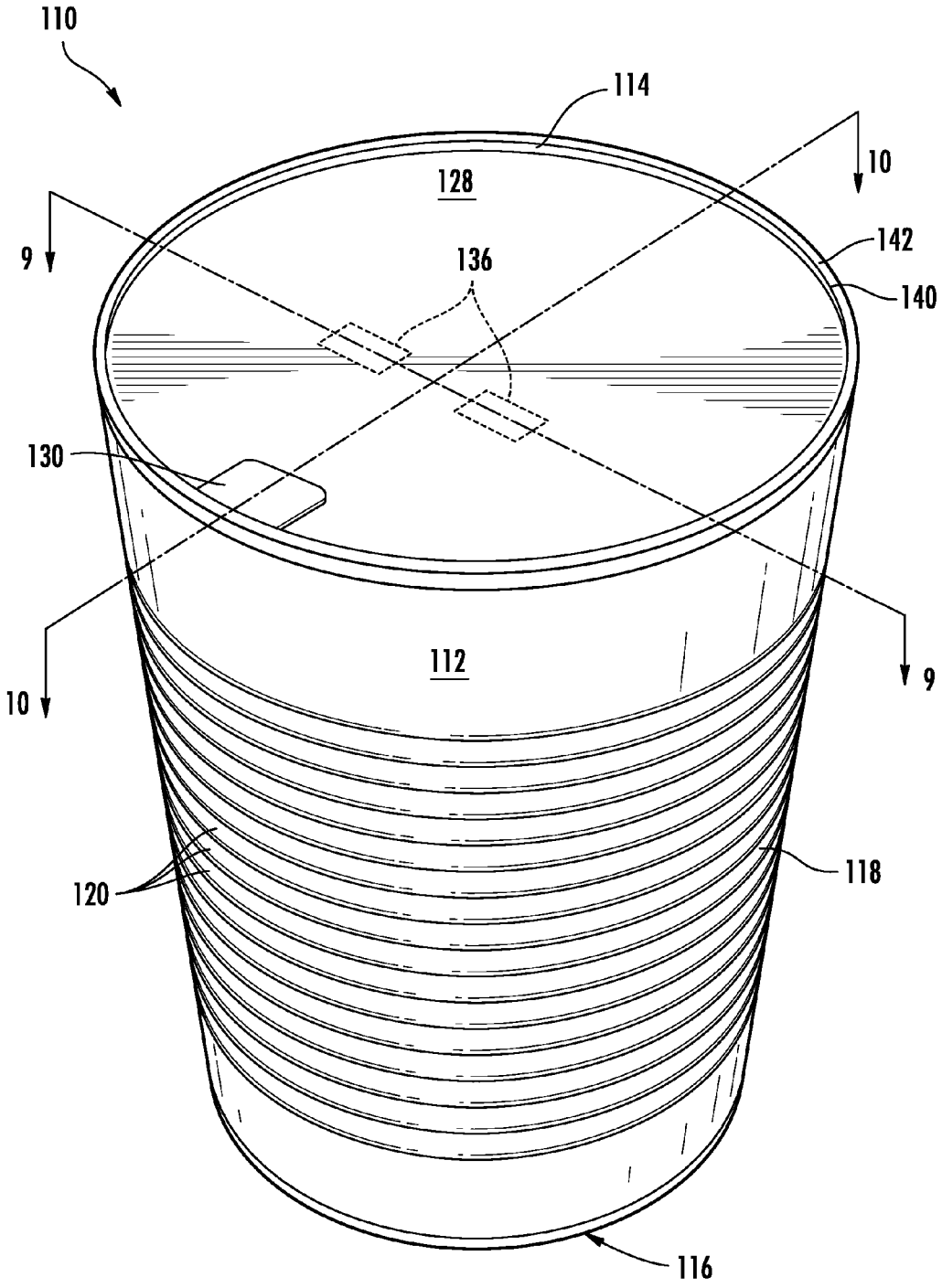
FIGS. 13-40 illustrate an alternative container configuration and various configurations for can ends which permit access to can contents without the use of an opener.
Figure 14:
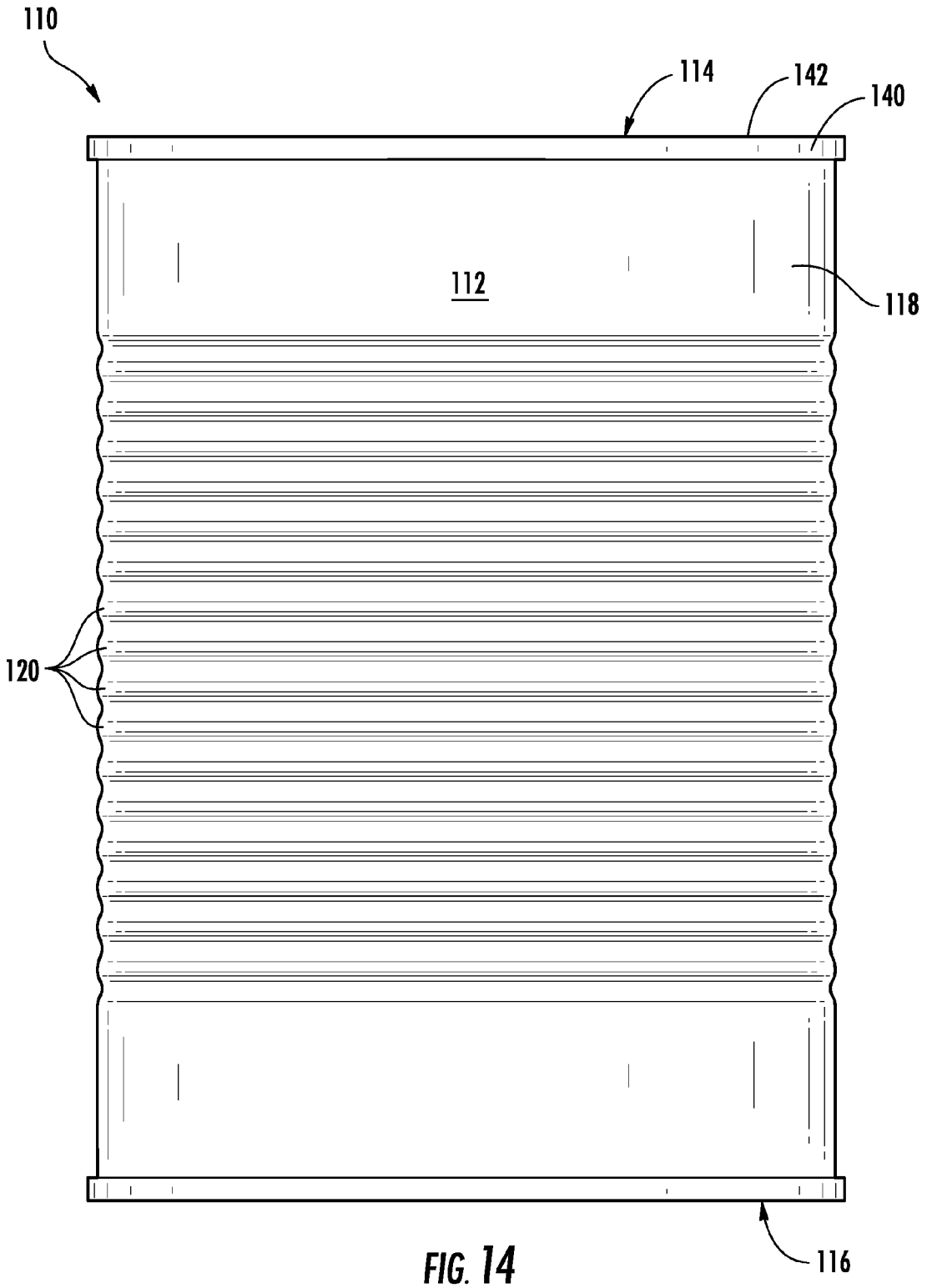

Still referring to FIGS. 13-17, a sheet 128 is selectively coupled (e.g., fastened, adhered, connected, glued, etc.) to the can end 114, such as for hermetically sealing the first and second openings 124, 126 when the container assembly 110 is in a closed configuration (e.g., FIG. 13). By way of non-limiting example, the sheet 128 may be generally circular, substantially covering the can end 114. In some embodiments, the sheet 128 includes a tab 130 or other lifting surface extending therefrom. In other embodiments, the sheet 128 may be otherwise shaped (e.g., rectangular, hourglass-shaped, oval, etc.). In contemplated embodiments, two or more separate sheets are used to cover different openings, or the same opening.

According to an exemplary embodiment, the sheet 128 may be fastened to the can end 114 with an adhesive 132 (FIG. 16) (e.g., adhesive layer, coating, glue, etc.) coupled to the sheet 128 and/or to the can end 114. In some embodiments, the adhesive 132 includes a thermoplastic layer or coating on the sheet 128—such as on a side of the sheet 128 that is to be fastened to the can end 114. Heating of the adhesive 132, such as by a heated press, temporarily melts the adhesive 132, which subsequently solidifies, bonding the sheet 128 to the can end 114. In some embodiments, the sheet 128 seals the can end 114 such that the container assembly 110 is hermetically sealed, helping to preserve perishable contents of the container assembly 110.

During operational use of the container assembly 110, the container assembly 110 may be converted from the closed configuration (FIG. 13) to the open configuration (FIG. 17) by decoupling (e.g., removing, peeling, lifting, separating, etc.) the sheet 128 from the can end 114. In some embodiments, the sheet 128 is coupled to the can end 114 such that the tab 130 is closer to the second opening 126 (or openings) than to the first opening 124. Referring specifically to FIG. 16, the tab 130 may be gripped by a user of the container assembly 110, and pulled upward and/or away from the can end 114. As the tab 130 is pulled, the sheet 128 allows access to and from the second opening 126 before then allowing access to the first opening 124.

According to an exemplary embodiment, the container assembly 110 is formed from metal, such as tin-coated steel or aluminum. In some embodiments, the can 112 is formed from aluminum and the can end 114 is formed from tin-coated steel. In other embodiments, other metals or materials (e.g., high-temperature plastic, ceramic, etc.) are used to form some or all of the container assembly 110. In some embodiments, the sheet 128 is a metal foil (e.g., aluminum foil, steel foil, etc.), having a thickness substantially between 1/1000 to 1/100-inch. The metal foil includes an outer (top, outside, etc.) layer (e.g., coating) of polyethylene terephthalate (PET), a middle layer (e.g., substrate) of foil, and a bottom layer (e.g., 70 microns thick) of polypropylene, where the outer layers are applied via a coextrusion process. The polypropylene is configured to be heated and used as an adhesive. In other embodiments, the metal foil includes additional layers of different materials, and/or layers of similar materials in different arrangements (e.g., order). In still other embodiments, the sheet 128 is plastic or composite (e.g., plastic foil with one or more coatings thereon).

Figure 29:
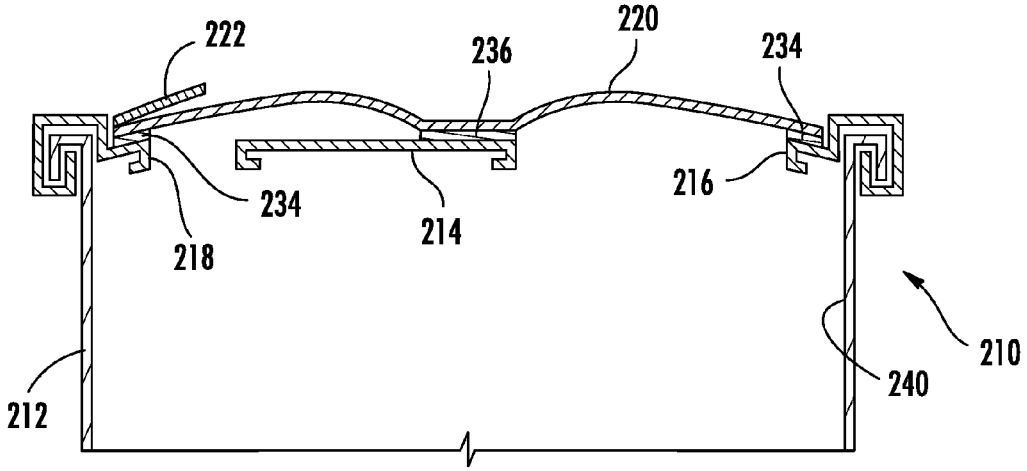

In some embodiments, the container assembly 110 is a three-piece assembly, formed from three main parts. The bottom 116 and sides 118 are separately stamped and fastened together, such as by forming the sides 118 into a cylindrical tube, and crimping an end of the tube to the bottom 116. According to an exemplary embodiment, a sealant or gasket (e.g., rubber coating) may be positioned between the crimped portions, to improve the seal therebetween. With the bottom 116 and sides 118 fastened together, the can 112 includes an open end 138 (FIG. 21), which may be covered by the can end 114. According to an exemplary embodiment, the can end 114 is also formed via stamping from a single metal sheet, and is fastened to the can 112. Edges internal to the openings may be rolled (see, e.g., rolled edges as shown in FIGS. 22 and 29). In other embodiments a container assembly is a two-piece assembly, where a can body (e.g., having sides and a bottom) is formed by a stamping process, from a single sheet of metal (e.g., aluminum), and a can end is separately formed, stamped from another sheet of metal. In some embodiments, components or features of a container assembly are formed by molding, die cast, blown, or otherwise formed.

The container assembly 110 may be fully assembled, as shown in FIG. 13, partially assembled (e.g., open configuration shown in FIG. 17), or may be an assembly that is configured to be, but not yet fastened together (e.g., assembly of kit components). For example, some embodiments may include a container assembly including a can end and a sheet configured to be coupled thereto. Other embodiments may include a container assembly including a can (e.g., body) and a can end, fastened together, but without a sheet coupled to the can end. Other contemplated embodiments include still other container assemblies, having components that are fastened together and separate components that are unfastened kits.

Figure 18:
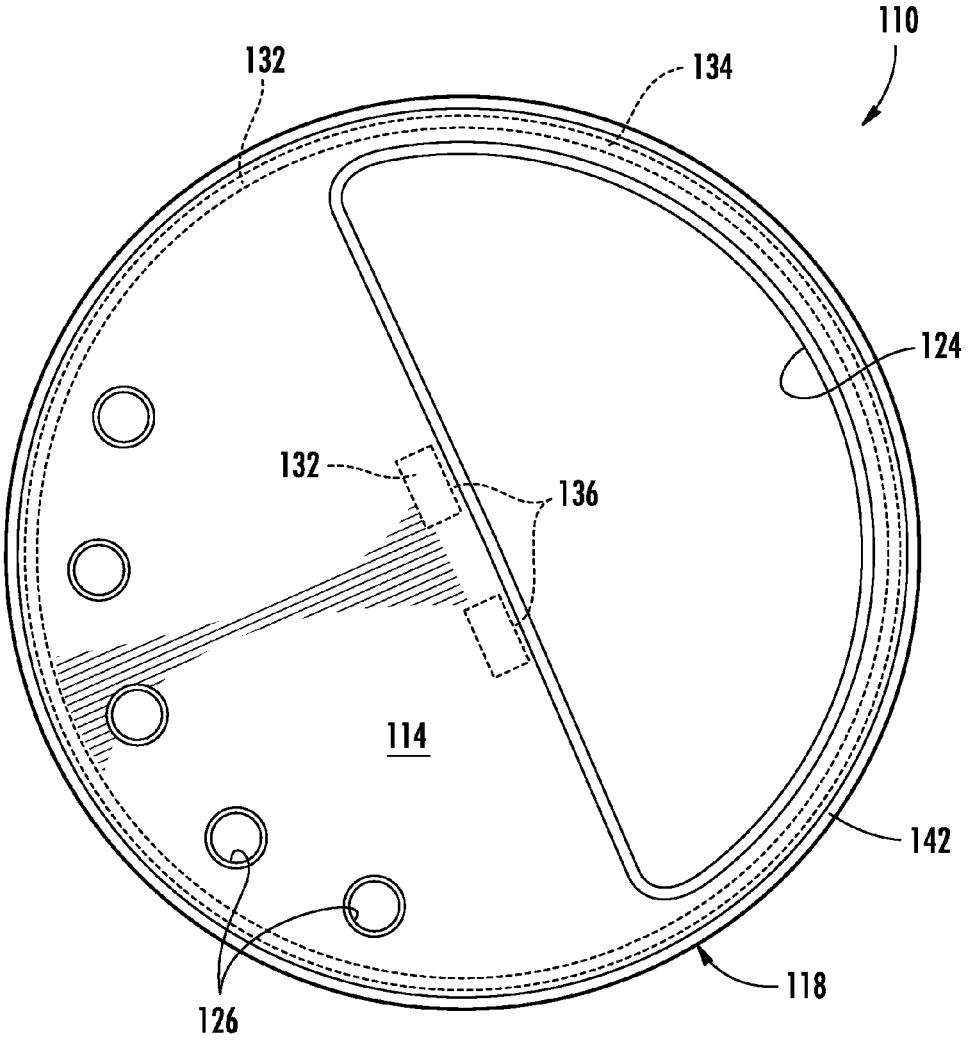
Figure 19:
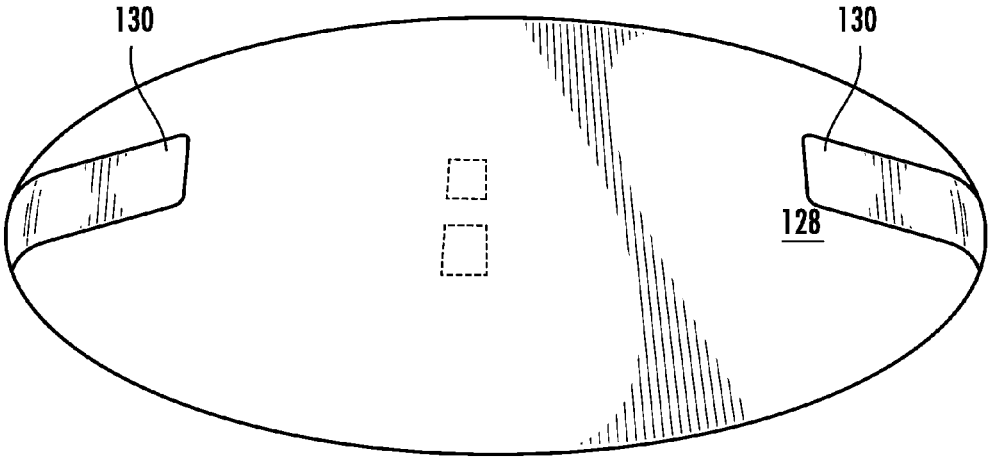
Figure 20:
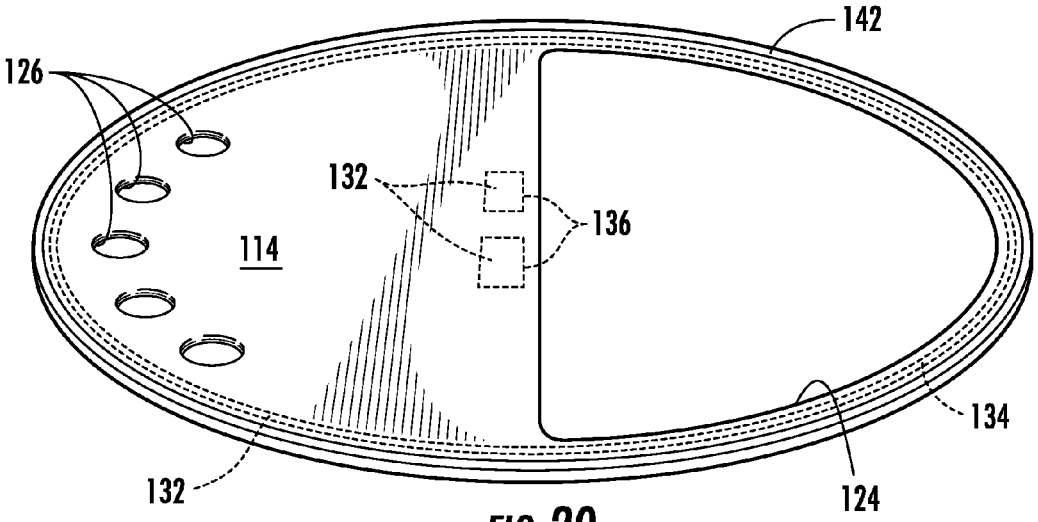
Figure 31:
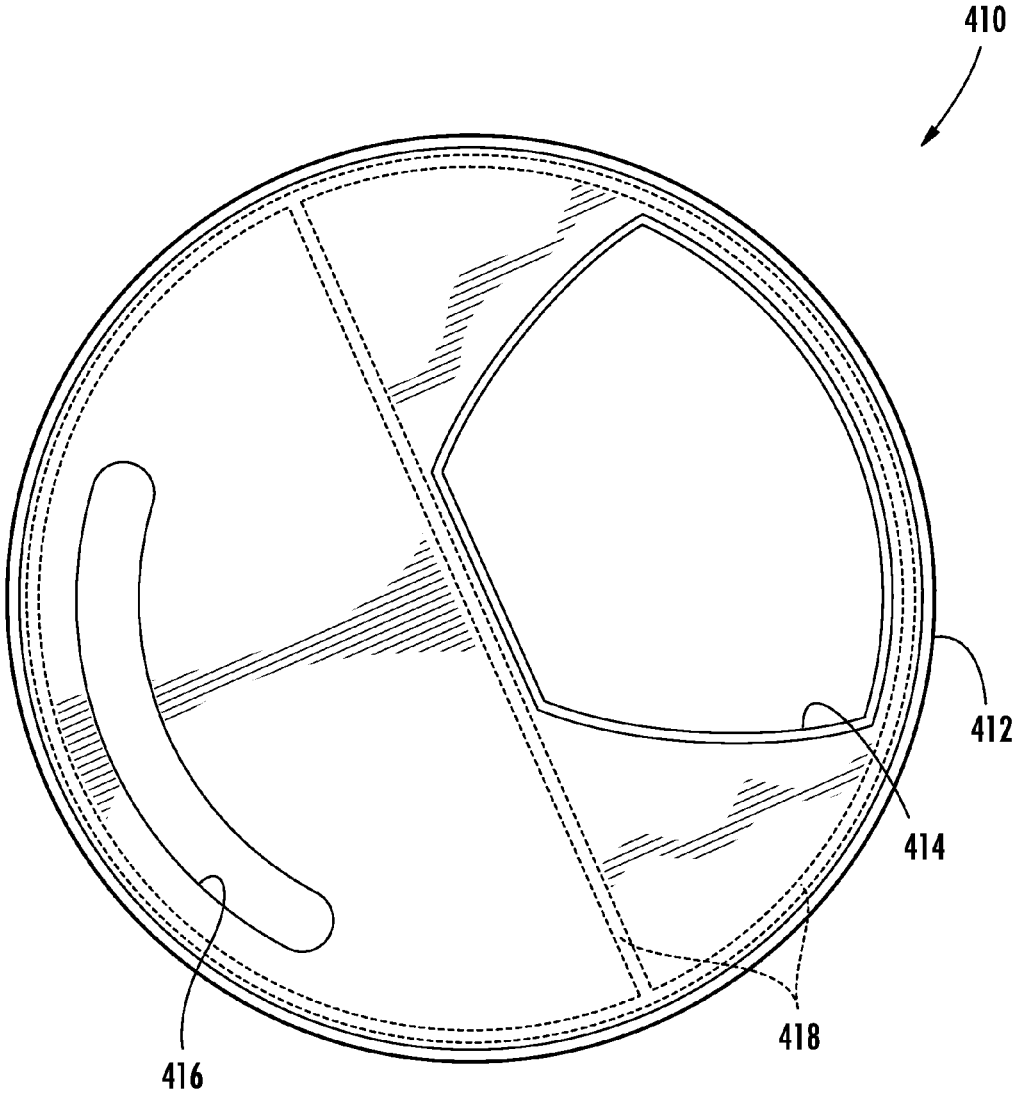

Referring to FIGS. 18-20, the can end 114 includes first and second fastening areas 134, 136 to which the sheet 128 may be fastened. The first fastening area 134 extends around the periphery of the can end 114 (and/or of the sheet 128), sealing both the first and second openings 124, 126 of the can end 114. The second fastening area 136 includes at least a portion thereof that is proximate to the center of the can end 114 (and/or of the sheet 128). In some embodiments, the second fastening area 136 connects (e.g., is continuous with) with the first fastening area 134 (see, e.g., fastening areas 418 as shown in FIG. 31).

Without wishing to be bound by any particular theory, it is believed that the second fastening area 136 helps to allow the sheet 128 to remain fastened to the can end 114 when pressure in the container assembly 110 (e.g., within the volume 122) exceeds pressure exterior to the container assembly 110 (e.g., atmospheric pressure, outside air pressure), such as during a retort process (e.g. heated and pressurized sterilization process). It is believed that the second fastening area 136 helps to mitigate shear forces between the sheet 128 and the can end 114 at the first fastening area 134, helping the sheet 128 to remain fastened to the can end 114 when gauge pressure (i.e., internal pressures relative to exterior pressure) within the container assembly is at least 10 pounds per square inch (psi), at least 15 psi, at least 25 psi, or more.

Figure 21:
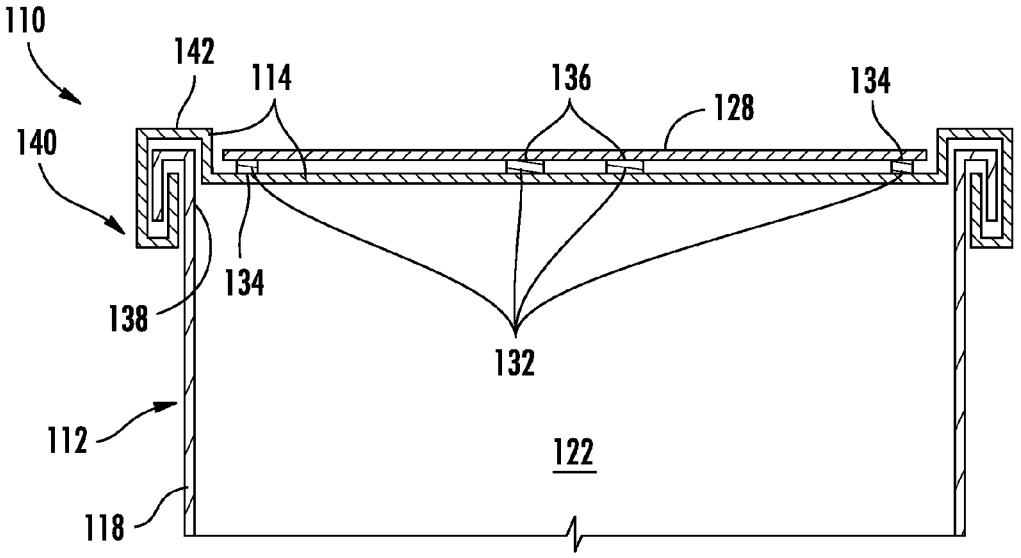
Figure 22:
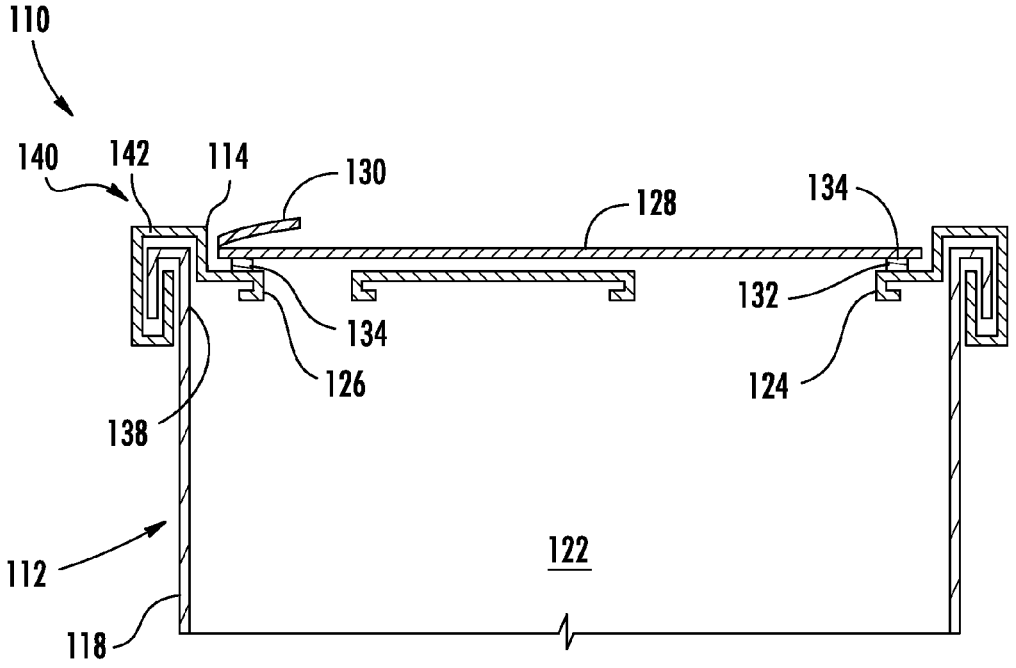

Referring to FIGS. 21-22, sides 118 of the can 112 extend upward to form an open end 138 of the can 112, to which the can end 114 is fastened. According to an exemplary embodiment, the can end 114 is fastened to the open end 138 of the can 112 by overlapping a portion of the can 112 with a portion of the can end 114, and bending (e.g., crimping) the portions into a sealed joint 140 assembly and a rim 142 of the container assembly 110. A sealant or gasket may be positioned between the portions, such as via a coating of sealant material (e.g., elastic material, pliable material, rubber, plastic, etc.) on either or both of the portions. Although the sealed joint 140 of FIGS. 21-22 shows a particular arrangement of bending and overlapping, other arrangements of bending and overlapping may be used for fastening the can end 114 to the sides 118 of the can 112. In still other contemplated embodiments, the can end 114 is otherwise fastened to the can 112 (e.g., glued, welded, pressure fit, etc.) or formed integrally therewith. According to an exemplary embodiment, the sheet 128 is then fastened to the can end 114, forming a closure to the first and second openings 124, 126 (FIG. 22).

Referring now to FIGS. 23-29, a container assembly 210 according to another exemplary embodiment includes a can 212 (e.g. can body) and a can end 214 fastened thereto. The can end 214 includes a first opening 216 and a second opening 218 (FIG. 13). A sheet 220 is fastened (e.g., adhered) to the can end 214, forming a closure to the first and second openings 216, 218. A tab 222 (e.g., pull tab, foil ring, pop top tab) may be used to pull the sheet 220 away from the can end 214, to open the openings 216, 218. In some embodiments, the sheet 220 is a foil sheet adhered to the can end 214 with a thermoplastic adhesive.

Figure 23:
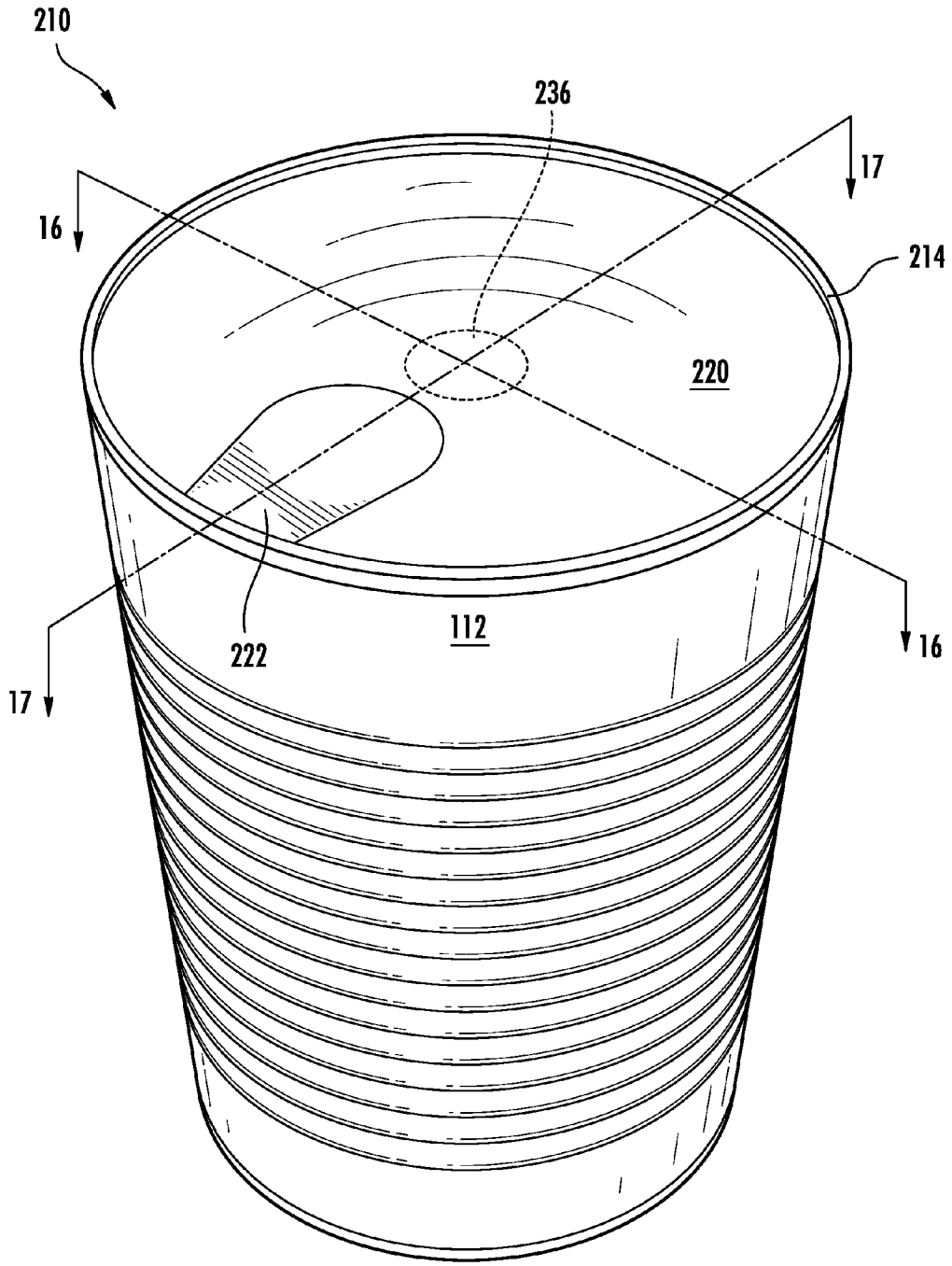
Figure 24:
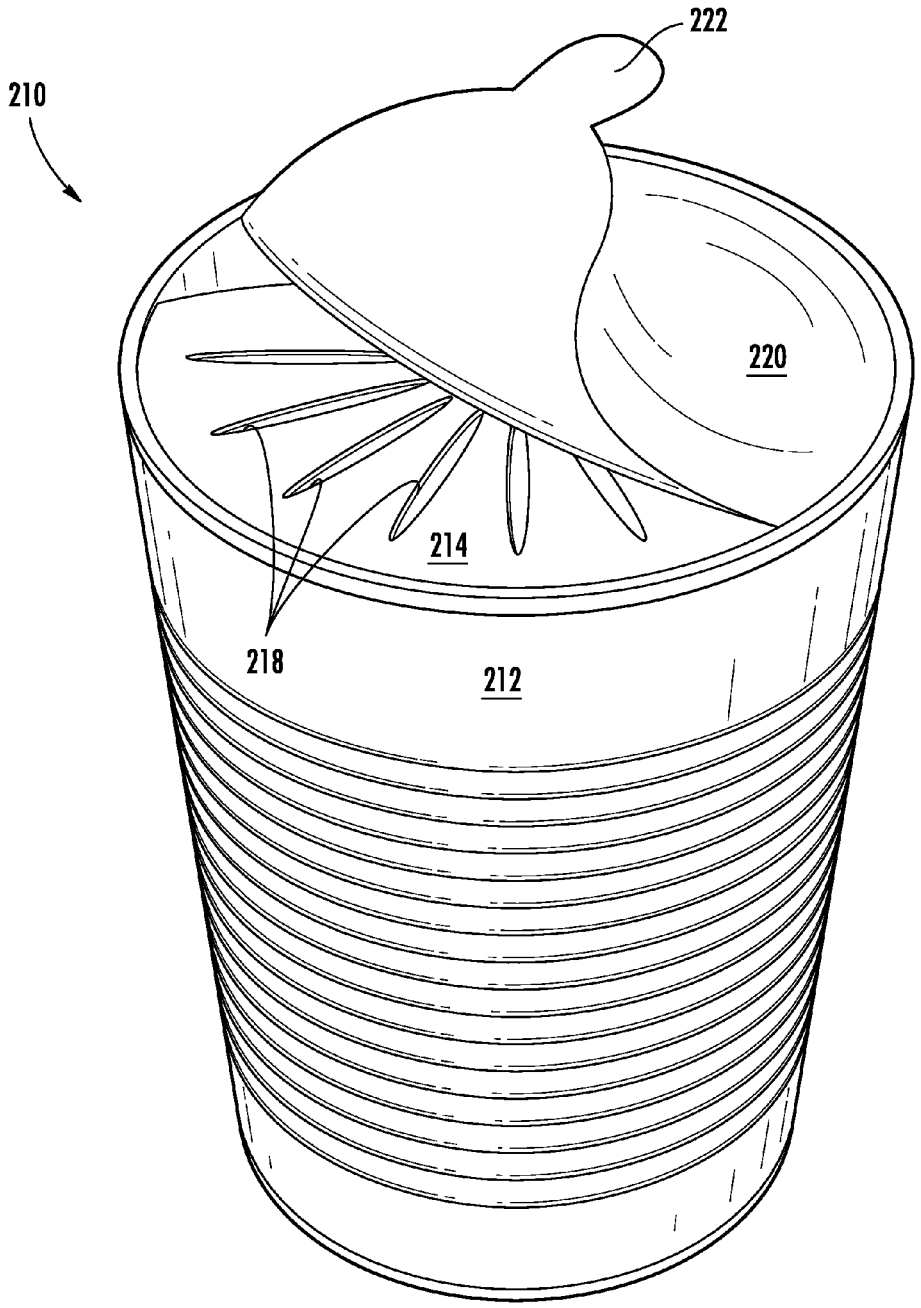
Figure 25:
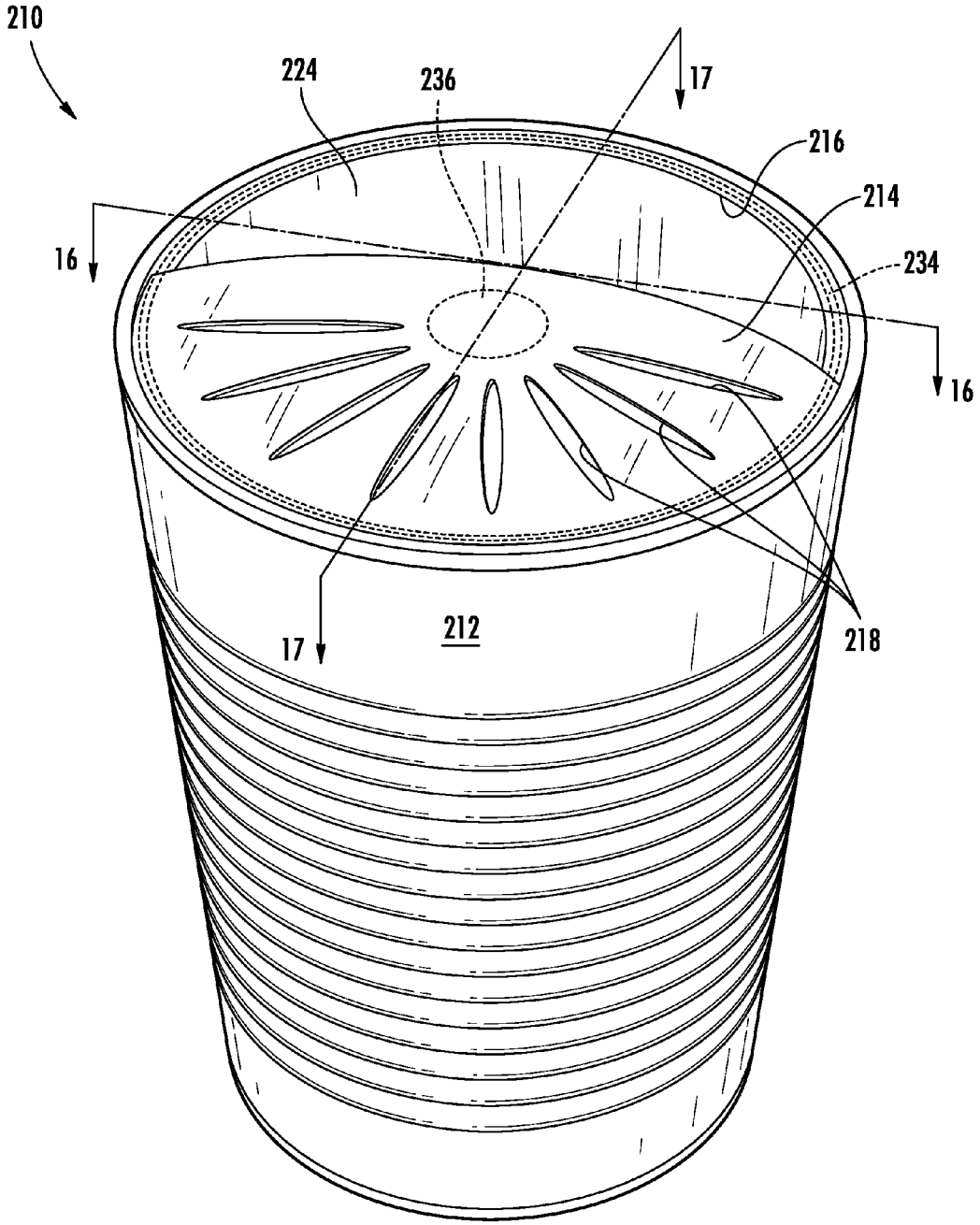

In FIGS. 23-27 the container assembly 210 is shown in various configurations. In FIG. 23, the container assembly 210 is in a closed configuration, with the sheet 220 hermetically sealing the openings 216, 218, and contents of the container assembly 210 stored therein. In FIG. 24, the sheet 220 has been partially removed (e.g., decoupled) from the can end 214, such that at least one of the first and second openings 216, 218 is at least partially exposed. In FIG. 25, the sheet 220 has been fully removed from the can end 214, opening both the first and second openings 216, 218. The volume 224 (FIG. 25) of the container assembly 210 is configured to hold at least one solid item 226 and a liquid 228 (FIG. 26) as contents therein. As shown in FIG. 26, when the container assembly 210 is in the open configuration (either partially, as shown in FIG. 24, or fully, as shown in FIG. 25) the can end 214 facilitates straining, such that the liquid 228 is pourable out of the volume 224 through the second opening 218 while the solid item 226 is generally blocked from passing through the second opening 218. In FIG. 15, the solid item 226 is pourable out of the first opening 216.

Figure 28:
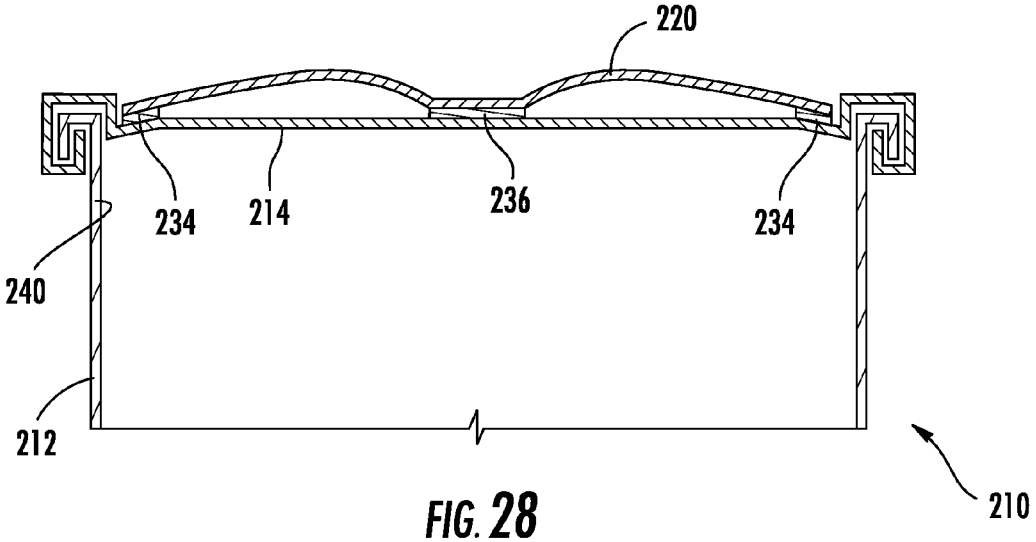

Referring now to FIGS. 28-29, the container assembly 210 includes sides 230 of the can 212 extending vertically to form an open end 240 of the can 212. A portion of the open end 240 is folded (e.g., crimped) with a portion the can end 214 to form a joint assembly 232. A sheet 220 is fastened to the can end 214 at first and second fastening areas 234, 236, forming a closure to the first and second openings 216, 218 in the can end 214. The can end 214 at the first fastening area 234 includes an angled ledge 238 (e.g., flange, extension, etc.). Without wishing to be bound by any particular theory, it is believed that angling the ledge 238 and using the angled ledge 238 as the fastening area 234 may support (e.g., strengthen, help, etc.) maintaining a sealed fastening between the sheet 220 and the openings 216, 218 of the can end 214 when pressures in the container assembly 210 exceed pressures exterior thereto, such as by aligning the plane of adhesion with the plane of maximum shear stress. The second fastening area 236 may be positioned proximate to the center of the can end 214. In other embodiments, a second contact area on the can end is also angled, indented, dimpled, or otherwise contoured, so as to facilitate maintaining a sealed fastening between the sheet 220 and the can end 214 during a retort process, such as by aligning the fastening to effectively withstand predicted loadings.

In contemplated embodiments, the sheet 220 is a single, integral metal sheet that has been crimped to the can to seal the can end having the openings 216, 218 therein. The metal sheet includes a tear path extending, for example, around a periphery thereof, and configured to allow for an interior portion of the metal sheet to be controllably torn free from the can end 214, unsealing the openings 216, 218. The metal sheet may be stamped from sheet metal (e.g., aluminum, tin-coated steel, etc.) of a similar type and thickness as the can end 214 and/or the can 212. The tab 222 (e.g., single pull tab) may be used to remove the entire metal sheet, and thereby simultaneously opening both openings 216, 218. In some embodiments, a tab may be riveted to the sheet, formed integrally therewith, or otherwise coupled to the sheet.

While the container assemblies 110, 210 are shown with the proportions in the Figures, other container proportions may be used. For example, contemplated embodiments include ⅞ size, 1-"picnic" size, size 303, size 10, and other size cans, such as those standard sizes and shapes that are commercially available in the United States and abroad. Such cans may be configured to hold 4 ounces, 10.5 ounces, and even over 100 ounces of liquid. Some embodiments are cylindrical, while other embodiments are rounded-rectangular (e.g., box container), and still other embodiments include other container assembly geometries.

FIGS. 30-37 show can ends for container assemblies according to various exemplary embodiments, which may be used for the purposes of (1) maintaining a closure between a sheet (e.g., foil cover) fastened to one of the can ends, during a retort process where pressure in the container assembly exceeds pressure external to the container assembly, and also (2) facilitating straining of solid contents of the container assembly from liquid contents thereof.

Figure 30:
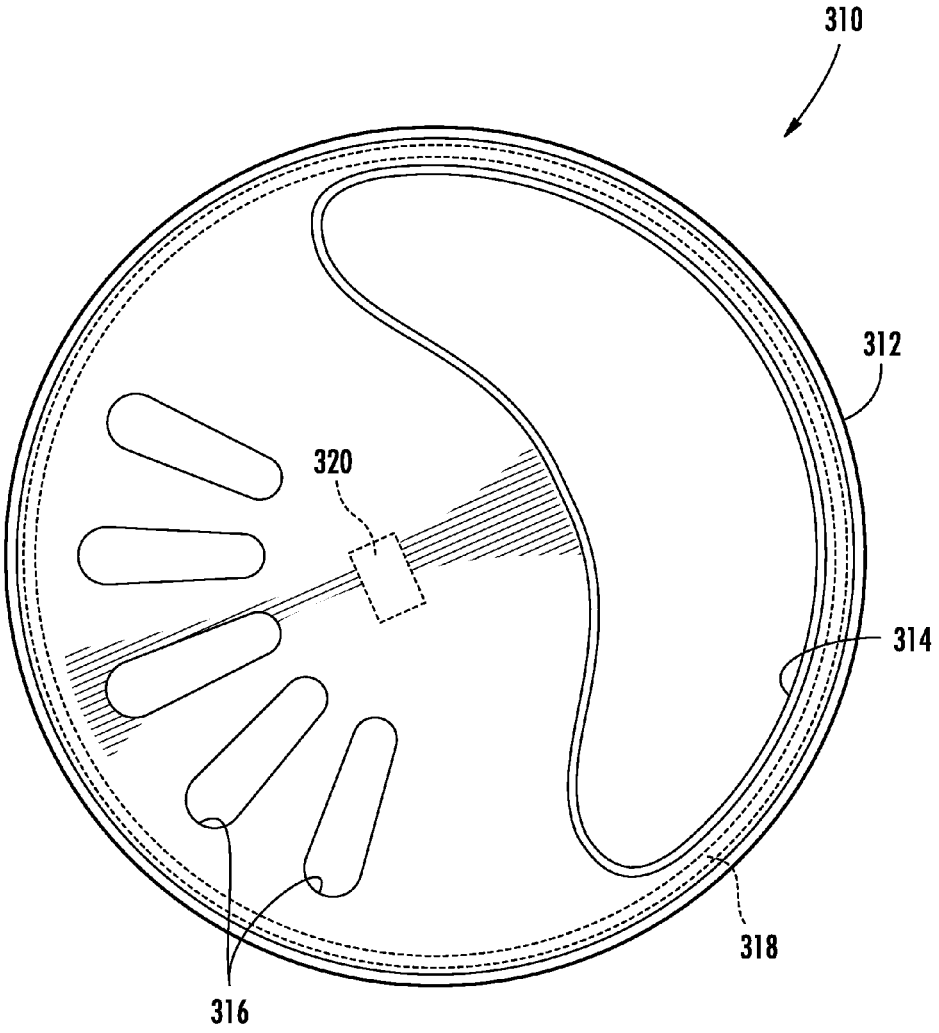

Referring to FIG. 30, a can end 310 includes a circular periphery 312 configured to be fastened (e.g., crimped) to a cylindrical can (see, e.g., can 112 as shown in FIG. 13), forming a container assembly. The can end 310 further includes a first opening 314 and at least one second opening 316. The first opening 314 is a large opening sized to allow solid contents of the container assembly to pass therethrough, the second opening 316 is at least one of a plurality of small openings configured to strain liquid from the solid contents of the container assembly. The first opening 314 is generally crescent-shaped, and has an area that is less than half the area of the overall can end 310. The can end 310 includes a first fastening area 318 and a second fastening area 320 to which a sheet (e.g., foil with thermoplastic adhesive layer) may be fastened, so as to hermetically seal the openings 314, 316. The first fastening area 318 extends around the periphery 312 of the can end 310, while the second fastening area 320 is positioned proximate to a center of the can end 310.

Referring to FIG. 31, a can end 410 includes a circular periphery 412 configured to be fastened to a cylindrical can to form a container assembly. The can end 410 includes a first opening 414 and a second opening 416. The first opening 414 is generally triangular and is sized to allow solid contents of the container assembly to pass therethrough. The second opening 416 is a curved slot, sized to block the solid contents from passing therethrough, but to allow liquid contents of the container assembly to pour therethrough. A sheet (see, e.g., sheet 128 as shown in FIG. 1) may be fastened to the can end 410 along a fastening area 418, which continuously extends around the periphery 412 of the can end 410 and across the diameter of the can end 410, between the first and second openings 414, 416.

Figure 32:
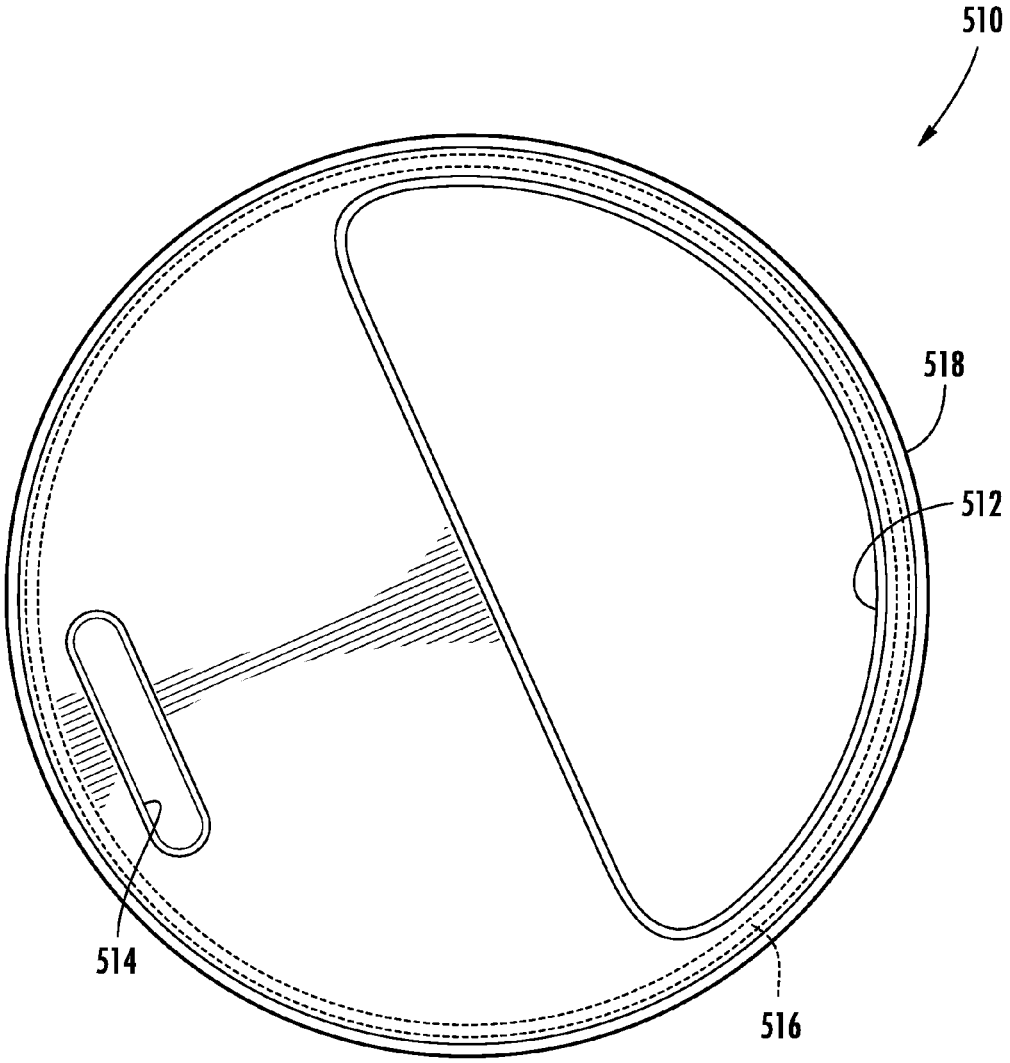

A can end 510 shown in FIG. 32 includes first and second openings 512, 514, where the second opening 514 is a straight slot configured to allow liquid contents of a container assembly to pour therethrough. One or both of the openings 512, 514 may include rolled edges. A fastening area 516 extends around a periphery 518 of the can end 510, allowing a sheet to seal the openings 512, 514.

Referring to FIG. 33, a can end 610 includes a circular periphery 612 configured to be fastened to a cylindrical can, forming a container assembly. The can end 610 includes first and second openings 614, 616, both large enough to allow solid contents of the container assembly to pass therethrough. Dividing the openings 614, 616, a strip 618 of solid material extends to a center platform 620, which may be used as a fastening surface 622. As such, a sheet may be fastened (e.g., glued) to the can end 610 via another fastening surface 624 around the periphery 612 of the can end 610 to seal the openings 614, 616, and in a center of the can end 610 on the platform 620.

Figure 34:
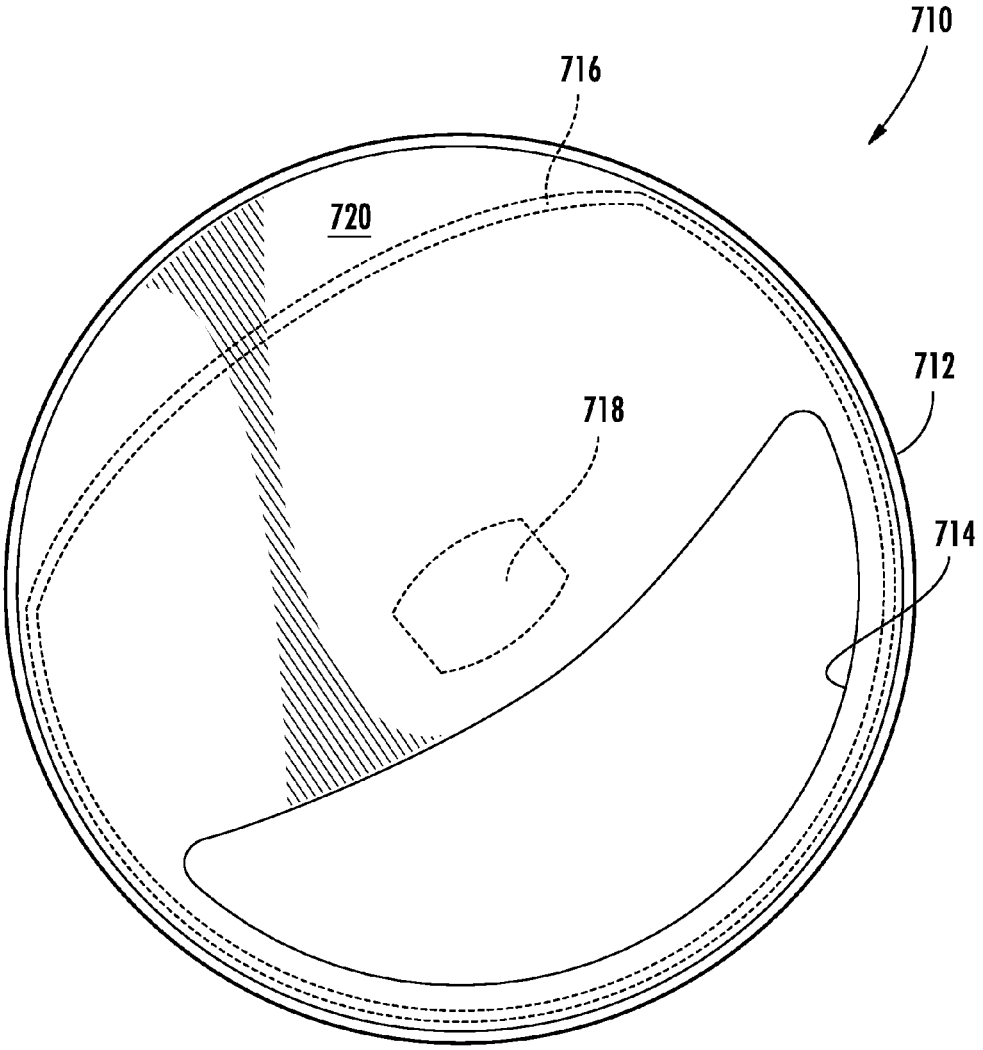

Referring to FIG. 34, a can end 710 includes a circular periphery 712 with an opening 714 therein, the can end 710 being configured to be fastened to a can, forming a container assembly. The opening 714 is generally crescent-shaped and is large enough to allow contents of the can to pass therethrough. The can end 710 includes first and second fastening areas 716, 718. The first fastening area 716 extends generally around the periphery 712 of the can end 710, however a portion 720 of the periphery 712 extends outside of the first fastening area 716. The portion 720 may allow for use of a sheet that is smaller in area than the full can end 710, or may allow for a corresponding portion of the sheet to be easily lifted from the can end 710 facilitating opening of the can end 710. The second fastening area 716 is proximate to a center of the can end 710—however, in other embodiments, a second fastening area is not positioned proximate to a center of a can end, or is not included (see, e.g., can end 610 as shown in FIG. 33).

Figure 35:
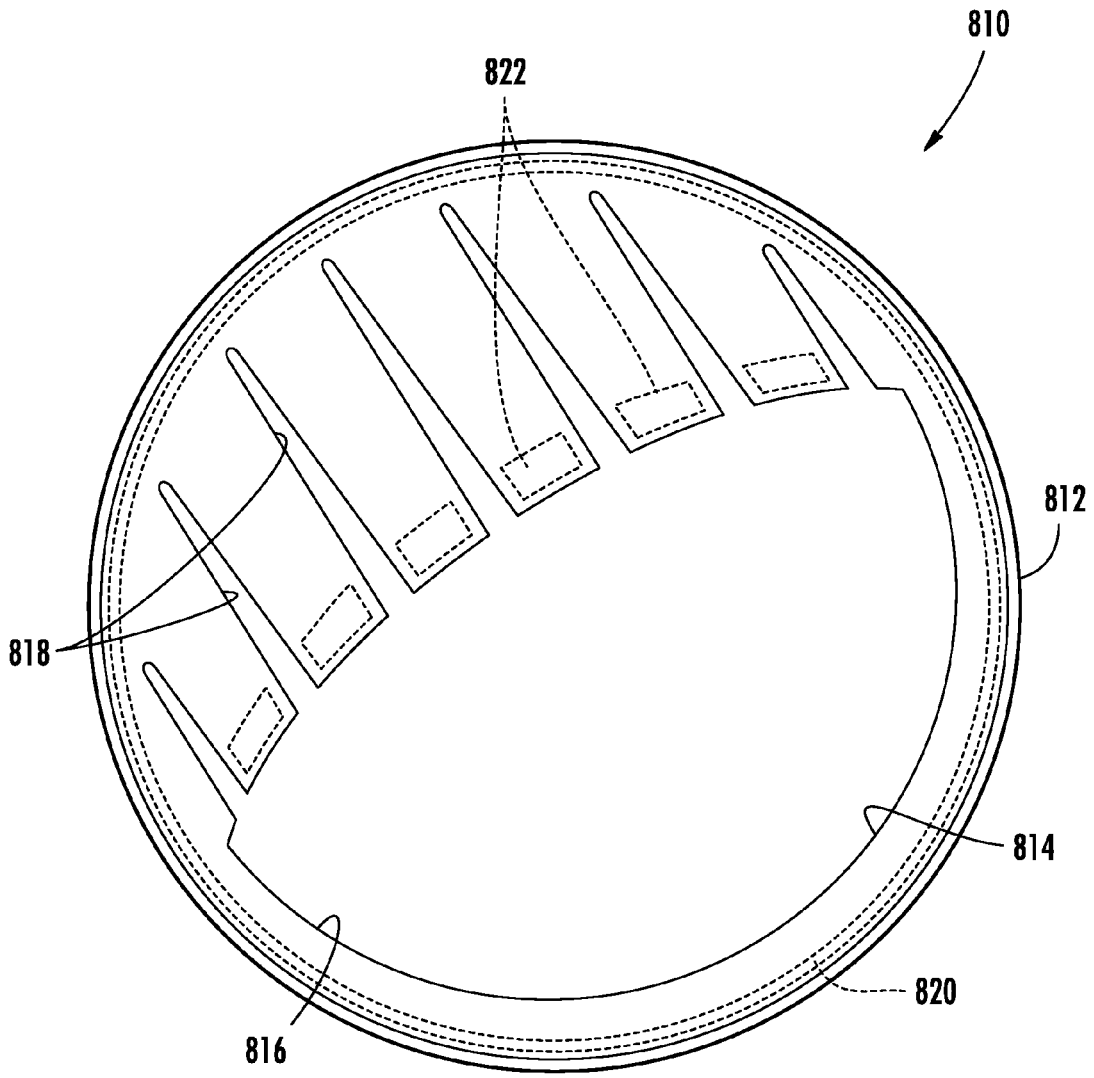

Referring to FIG. 35, a can end 810 includes a circular periphery 812 with an opening 814 therein, the can end 810 being configured to be fastened to a can to form a container assembly. The opening 814 may be functionally separated into first and second openings 816, 818, where the first opening 816 is wide enough to allow solid contents of the container assembly to pass therethrough and the second opening 818 is narrow enough to block the solid contents, for straining. A first fastening area 820 extends around the periphery 812 of the can end 810, and one or more second fastening areas 822 are positioned proximate to the center of the can end 810.

Figure 36:
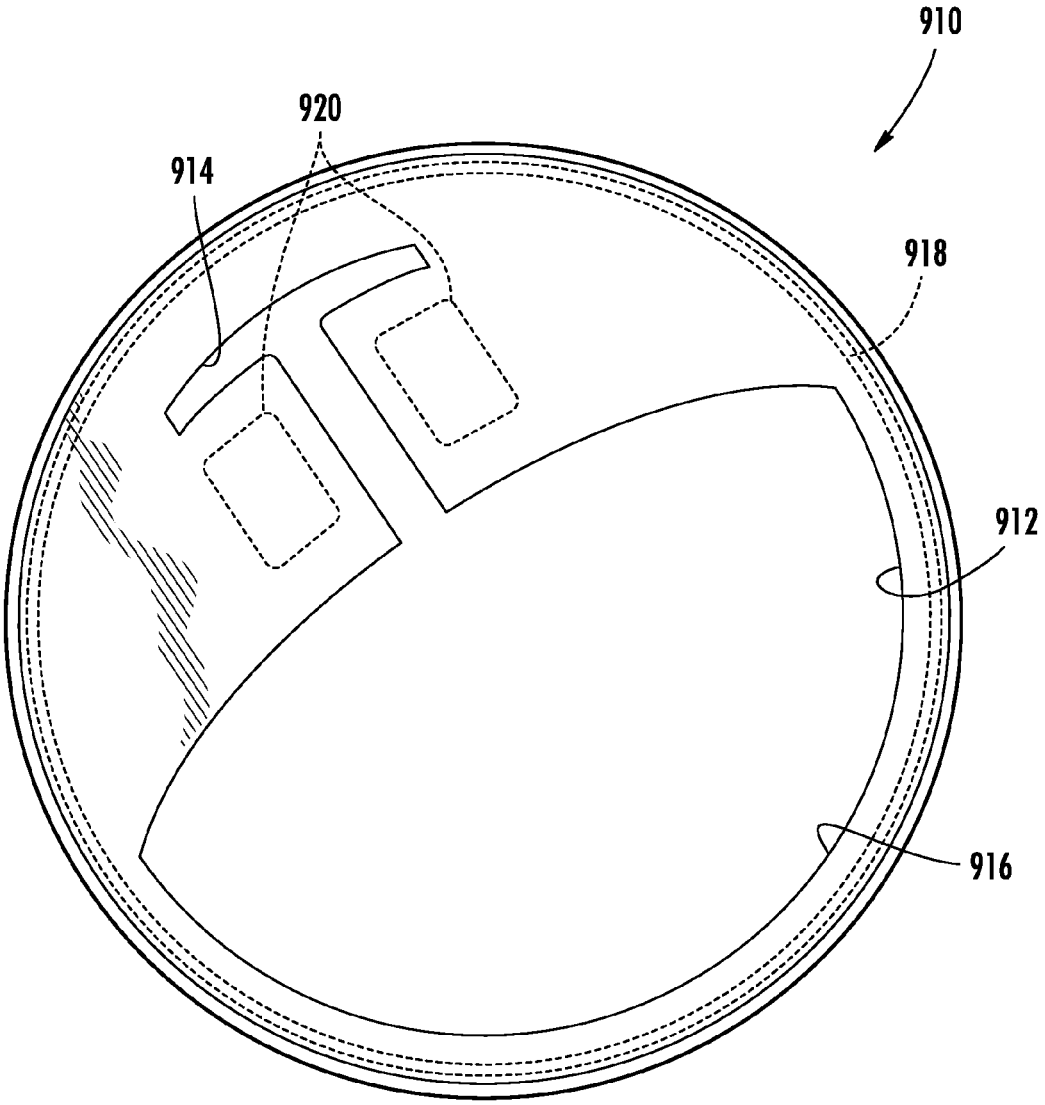

A can end 910 shown in FIG. 36 also includes an opening 912 that can be functionally separated into a strainer opening 914 and a main opening 916, for a container assembly. Fastening areas 918, 920 around the opening 914 and proximate to a center of the can end 910 may be used to fasten a sheet to the can end 910.

Figure 37:
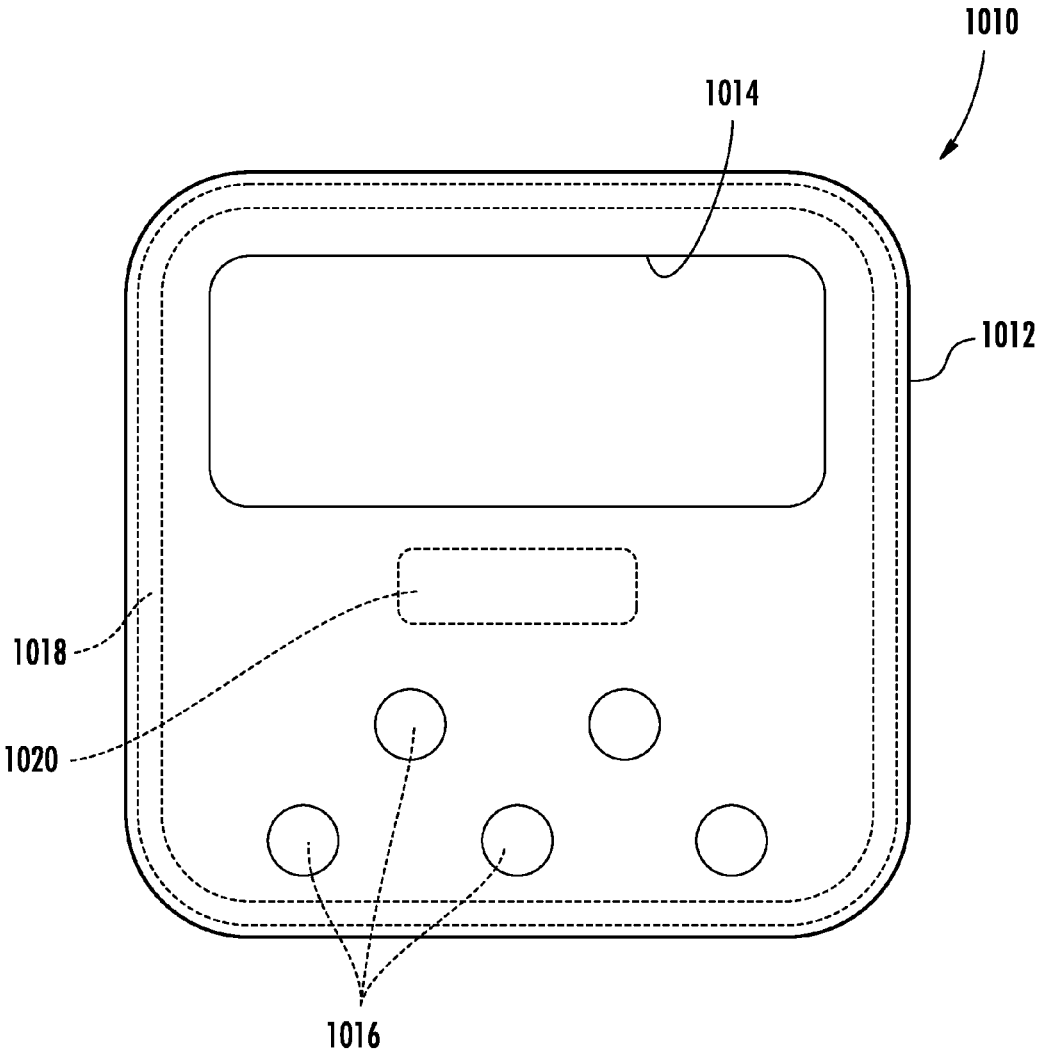

Referring to FIG. 37, a can end 1010 includes a generally rectangular periphery 1012 configured to be fastened to a rectangular container, forming a container assembly. The can end 1010 includes a first opening 1014 through which solid contents of the container assembly may be poured, and at least one second opening 1016 through which liquid contents of the container assembly may be strained from the solid contents. Fastening areas 1018, 1020 may be used to fasten a sheet (e.g., square foil sheet) to the can end 1010.

Figure 38:
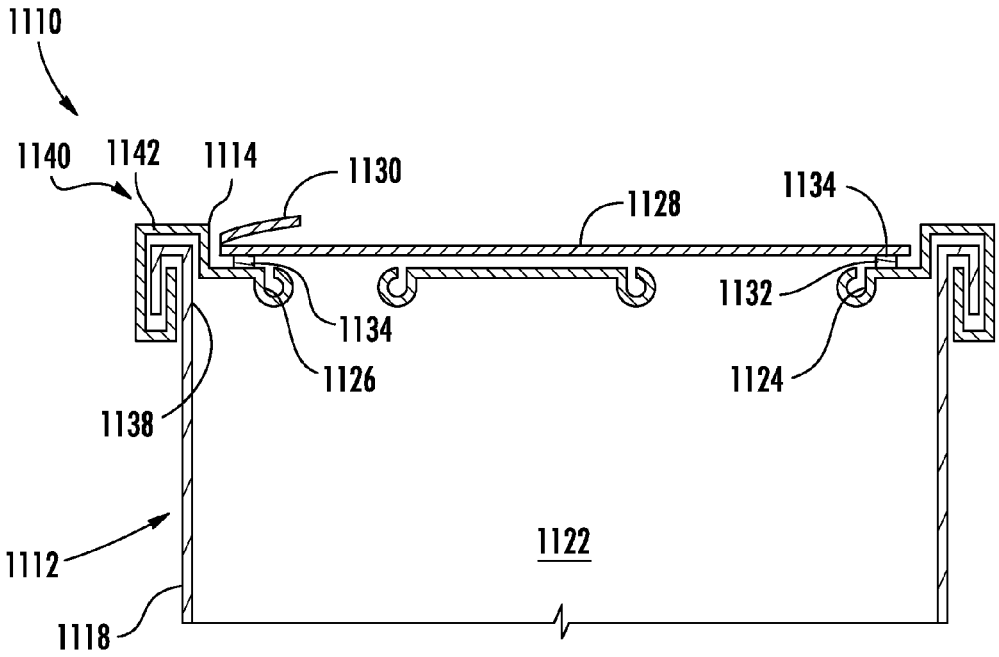

Referring to FIG. 38, a container assembly 1110 (e.g., two-piece or three-piece container assembly) includes sides 1118 of a can 1112 that extend upward to form an open end 1138 of the can 1112, to which a can end 1114 is fastened. According to an exemplary embodiment, the can end 1114 is fastened to the open end 1138 of the can 1112 by overlapping a portion of the can 1112 with a portion of the can end 1114, and bending (e.g., crimping) the portions into a sealed joint 1140 assembly and a rim 1142 of the container assembly 1110. A sealant or gasket may be positioned between the portions. According to an exemplary embodiment, the sheet 1128 is then fastened to the can end 1114 with adhesive 1132 at fastening areas 1134, forming a closure to first and second openings formed by outward rolling of portions 1124, 1126 of the can end 1114. A tab 1130 may be pulled to help remove the sheet 1128 to access content stored in the volume 1122 of the container assembly 1110.

Figure 39:
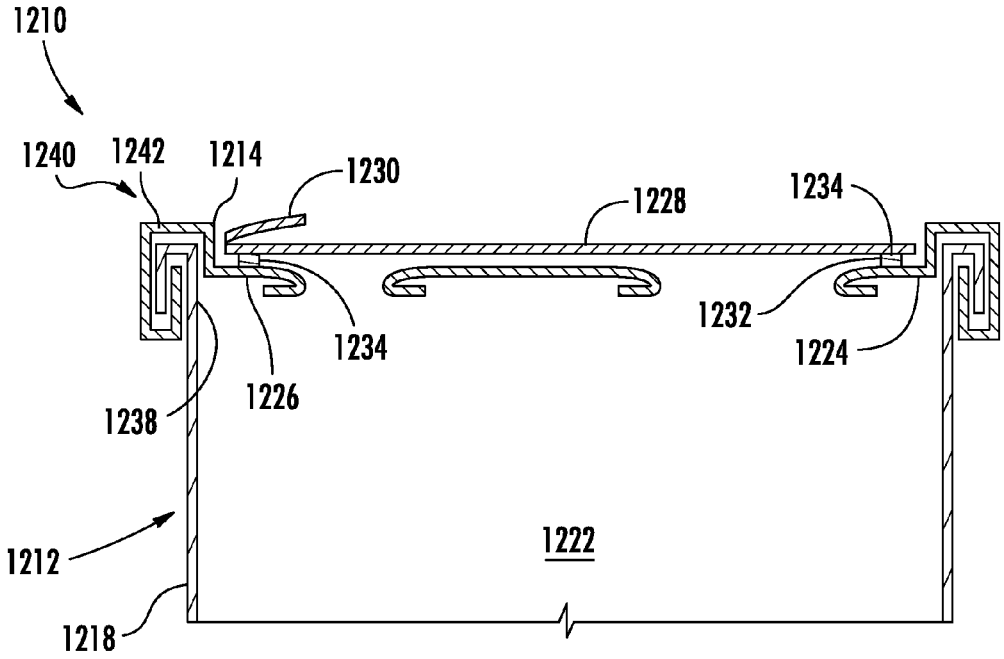

Referring to FIG. 39, another container assembly 1210 includes sides 1218 of a can 1212 that form an open end 1238 of the can 1212, to which a can end 1214 is fastened. The can end 1214 is fastened to the open end 1238 of the can 1212 by overlapping a portion of the can 1212 with a portion of the can end 1214, and crimping the portions into a sealed joint 1240 and a rim 1242. A sealant may be positioned between the portions. The sheet 1228 is then fastened to the can end 1214 with adhesive 1232 at fastening areas 1234, forming a closure to first and second openings formed by inward folding of portions 1224, 1126 of the can end 1214. A tab 1230 may be pulled to help remove the sheet 1228 to access content stored in the volume 1222 of the container assembly 1210.

Figure 40:
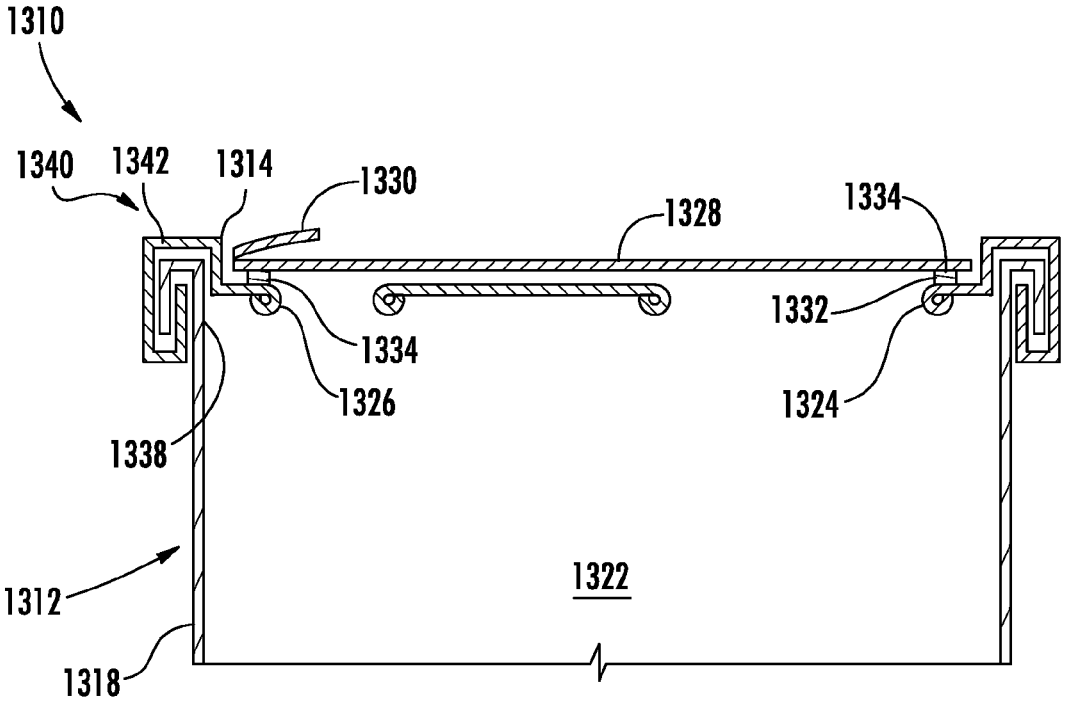

Referring now to FIG. 40, yet another container assembly 1310 includes sides 1318 of a can 1312 that form an open end 1338 of the can 1312, to which a can end 1314 is fastened. The can end 1314 is fastened to the open end 1338 of the can 1312 by overlapping a portion of the can 1312 with a portion of the can end 1314, and crimping the portions into a sealed joint 1340 and a rim 1342. A sealant may be positioned between the portions. The sheet 1328 is then fastened to the can end 1314 with adhesive 1332 at fastening areas 1334, forming a closure to first and second openings formed by inward curling of portions 1324, 1326 of the can end 1314. A tab 1330 may be pulled to help remove the sheet 1328 to access content stored in the volume 1322 of the container assembly 1310.

Figure 42:
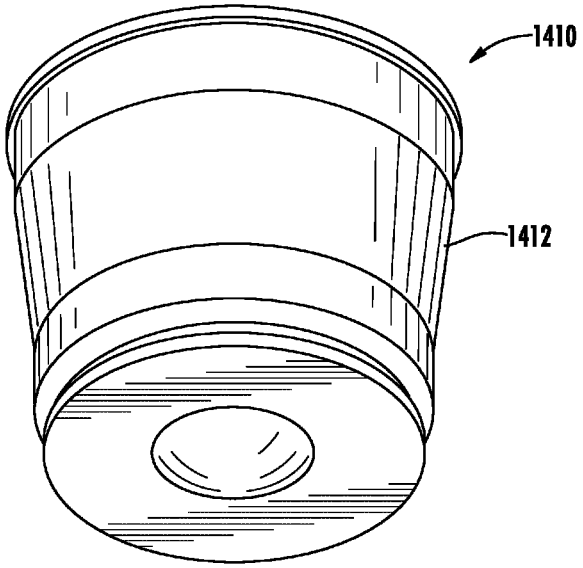
FIG. 42 is a bottom perspective view of an embodiment of a self-heating container.
Figure 43:
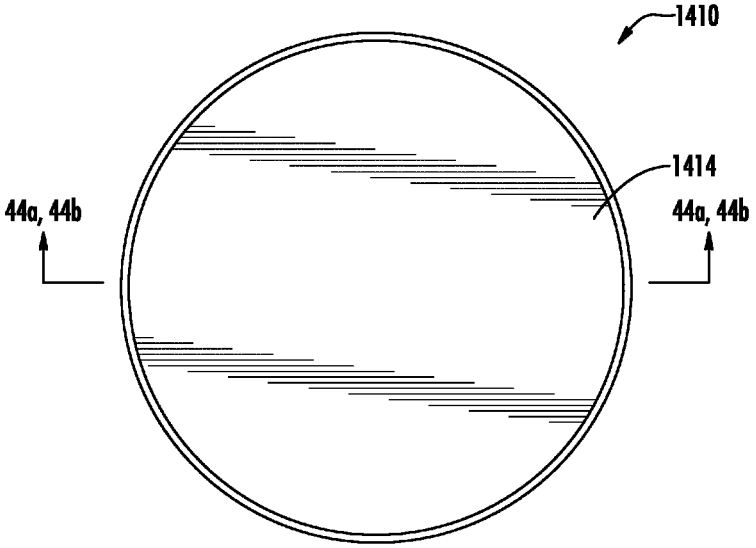
FIG. 43 is a top view of the container of FIG. 42.
Figure 44A:
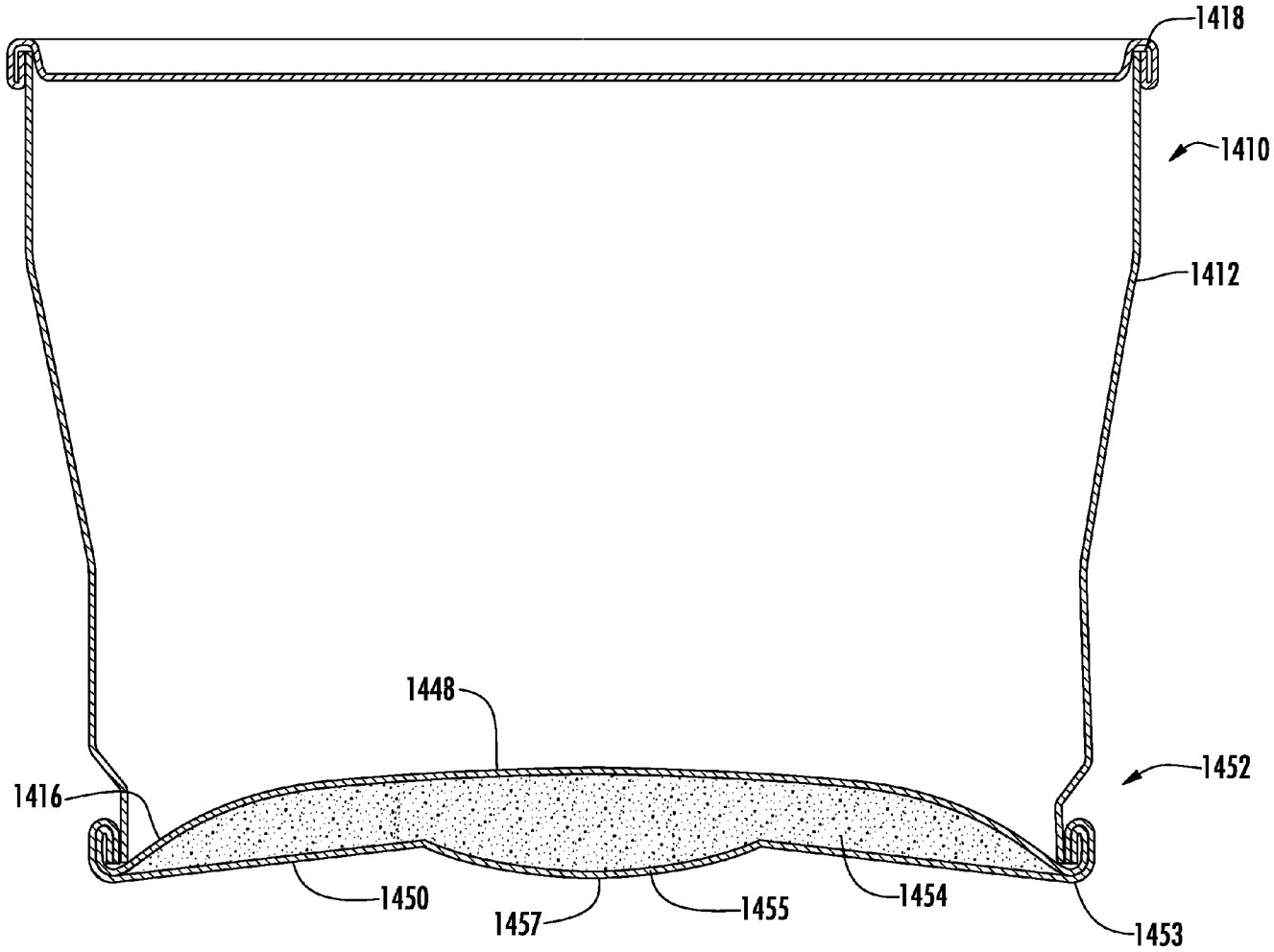
FIG. 44*a* is a cross-sectional view of the container of FIG. 42 taken along the line 44*a*-44*a* in FIG. 42.

FIGS. 42 and 43 illustrate an additional embodiment of a self-heating container 1410. The self-heating container 1410 is similar in some aspects to previously described embodiments, therefore, various differences will be highlighted. With further reference to FIG. 44*a*, the self-heating container 1410 includes a bottom, can end 1416. The bottom, can end 1416 includes a depression portion 1448 extending into the interior of the container 1410. In the embodiment illustrated in FIG. 44*a*, the depression portion 1448 extends gradually inwardly from the periphery to the center of the bottom, can end 1416. However, various other suitable configurations are envisioned, including depression portions 1448 that start closer to the center of the bottom, can end 1416, depression portions 1448 of other slopes, and depression portions 1448 extending various axial distances into the interior of the container 1410. The depression portion 1448 may be of any suitable shape known in the art, and may extend various distances into the interior of the container 1410 based on various factors as will be appreciated by those having ordinary skill in the art.

The container 1410 further includes a closure panel 1450. The closure panel 1450 and the bottom, can end 1416 may interface proximate their radially outer ends, and may define between them a chemical enclosure 1454 into which chemicals may be deposited. Depending upon the container's use, the closure panel 1450 may be formed from any suitable material known in the art. Examples of panel materials include metals, including steel, plastics, plastic lined metal, etc.

In one embodiment the closure panel 1450 and the bottom, can end 1416 are both joined to the side wall 1412 with a rolled joint or soldered joint 1452 (i.e., a triple seam). This triple seam 1452 may hermetically seal the closure panel 1450 and the bottom can end 1416 to the sidewall 1412, preventing escape of the contents of the container 1410 or ingress of contaminants into the contents of the container 1410.

In one embodiment, the closure panel 1450 defines an outwardly projecting depressible portion 1455 which projects away from the bottom, can end 1416. The depressible portion 1455 may be of any suitable shape and configuration known in the art. The depressible portion 1455 may be configured such that it is easily accessible by a user, however, the bottom-most portion 1457 of the depressible portion 1455, in one embodiment, may not extend axially downwardly beyond the bottom 1453 of the triple seam 1452, thus tending to avoid accidental depression of the depressible portion 1455 and allowing the container 1410 to be set down or stacked without depressing the depressible portion 1455.

The chemicals deposited within the chemical enclosure 1454 may be selected and configured within the chemical enclosure 1454 such that when the depressible portion 1455 is depressed by a user, the chemicals will be activated and begin to produce heat. The chemicals may be, for example aluminum and silica, or any other suitable chemicals known in the art.

In one embodiment, the depressible portion 1455 may include a piercing element (i.e. lance, metal point, pin, etc.). Depression of the depressible portion 1455 may rupture a metal or plastic membrane configured within the chemical enclosure 1454 to maintain separation of the various chemicals deposited within the chemical enclosure. Rupture of the membrane allows mixing and chemical reaction of the chemicals within the chemical enclosure 1454, which for various suitable combinations of chemicals, will produce heat. Various other suitable configurations for activating the chemicals upon depression of the depressible portion 1455 are also envisioned.

Figure 44B:
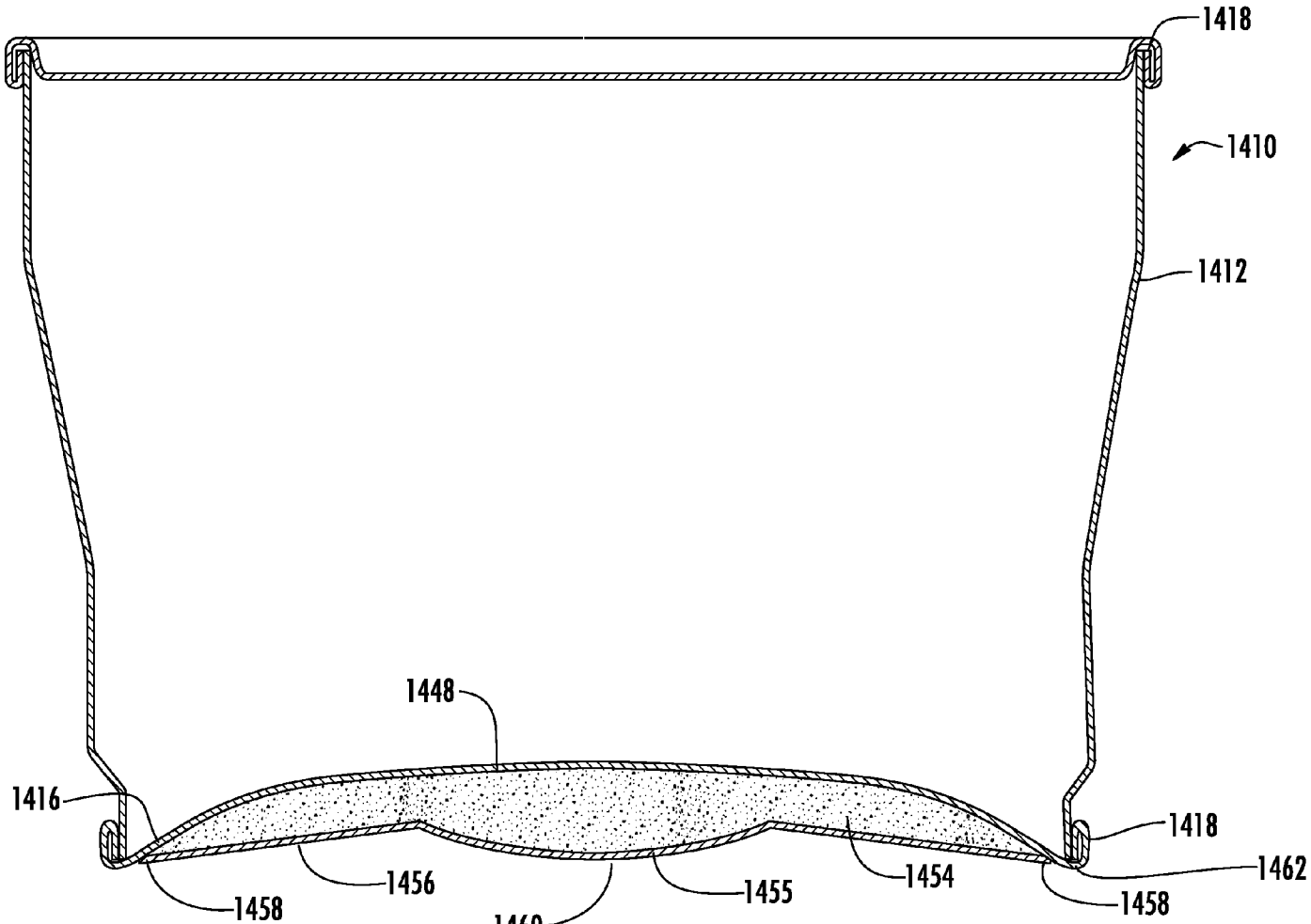
FIG. 44*b* is a cross-sectional view of the container of FIG. 42 taken along the line 44*b*-44*b* in FIG. 42.

With reference to FIG. 44*b*, in another embodiment, a direct apply foil 1456 may be adhered or coupled to the bottom, can end 1416 proximate its periphery 1458 to define a chemical enclosure 1454. The direct apply foil 1456 may be metal foil, thermoplastic, or any other suitable material or combination of materials known in the art.

The direct apply foil 1456 may be adhered or coupled to the bottom, can end 1416 by laser welding, ultrasonic welding, friction stir welding, adhesive, or any other suitable method known in the art. The seal between the bottom, can end 1416 and the direct apply foil 1456 may be hermetic or non-hermetic.

The direct apply foil 1456 may also define a outwardly extending depressible portion 1455 extending away from the bottom, can end 1416. The depressible portion 1455 may be suitable, upon depressing by a user, to activate the chemicals contained within the chemical enclosure 1454, causing the chemicals to generate heat when the depressible portion 1455 is actuated. As in the previous embodiment, the depressible portion 1455 may be of any suitable shape, but may be configured such that the bottom-most portion 1460 of the depressible portion 1455 is easily accessible by a user, but does not extend below the bottom-most portion of the double seam 1418, thus allowing the container 1410 to be set down or stacked without unintentional actuation of the depressible portion 1455. Additionally, other configurations and shapes of depressible portions 1455 are also envisioned.

Although these embodiments are described in conjunction with depressible portions, other configurations allowing for selective activation of chemicals contained within a chemical enclosure 1454 are also envisioned.

In one embodiment, the bottom can end 1416, the direct apply foil 1456, and the chemicals may be preassembled such that the combination would be a pre-prepared element to be attached to a container sidewall 1412. In this embodiment, the bottom can end 1416 may be joined to the side wall 1412 with a rolled joint or soldered joint 1418 (i.e., double seam) hermetically sealing the bottom can end 1416 to the sidewall 1412, with the direct apply foil 1456 coupled to the container 1410 by virtue of the weld or adhesive at the periphery 1458 of the bottom can end 1416 without needing to be directly attached or rolled to the container sidewall 1412.

The construction and arrangements of the container assembly, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A self-heating container comprising;

a cylindrical metal side wall;

a top, can end joined to the metal side wall with a joint;

a metal, bottom can end joined to the metal side wall to form an enclosure having an interior, the metal bottom can end including a depression extending into the interior; wherein the depression has a depth and a radius, wherein the depth is less than the radius; and a heating element including a canister located at least partially within the depression, the canister having chemicals hermetically sealed therein and an activation structure configured to permit a user to cause the chemicals to react and increase the temperature of the interior of the container, wherein the canister is sized relative to the depression of the metal bottom can end such that the canister is held within the depression via an interference fit formed between an outer surface of the canister and a surface of the depression;

wherein the canister is a cylindrical metal canister including a metal upper wall, a cylindrical metal side wall and a metal lower wall, wherein a diameter of the lower wall of the canister is less than a diameter of the bottom can end, wherein the depression is a cylindrical depression and wherein the interference fit is formed between an outer surface of the cylindrical metal side wall of the canister and a cylindrical surface of the depression;

wherein the metal bottom can end and the metal lower wall of the canister are coplanar.

2. The container of claim 1, wherein at least a portion of cylindrical the metal side wall of the container is tapered.

3. The container of claim 1, wherein the depression includes ribs which interact with the canister to hold the canister within the depression.

4. The container of claim 1, wherein the top can end is joined to the cylindrical metal side wall of the container with a rolled joint.

5. The container of claim 4, wherein the bottom can end is joined to the cylindrical metal side wall of the container with a rolled joint, wherein the metal bottom can end includes a substantially horizontal section extending between the depression and the rolled joint joining the bottom can end to the cylindrical metal side wall of the container.

6. The container of claim 1, wherein the depression is a shaped to match the cylindrical canister, wherein the depth of the cylindrical depression is between 0.3 inches and 1.0 inches and the radius of the cylindrical depression is between 0.75 inches and 1.5 inches.

7. A temperature changing container comprising:

a plurality of walls joined to form an enclosure which hermetically seals a contents of the enclosure within the walls, wherein one of the walls includes a depression extending into the contents of the enclosure, wherein the depression has a depth and a radius, wherein the depth is less than the radius; and a temperature changing element including a canister located at least partially within the depression, the canister having an upper end, a lower end, a sidewall joining the upper end and the lower end, and chemicals hermetically sealed therein and an activation structure configured to permit a user to cause the chemicals to change state to change the temperature of the canister, wherein an outermost diameter of the lower end of the canister is less than an outermost diameter of the wall including the depression;

wherein the canister is a cylindrical metal canister including a metal upper wall, a cylindrical metal sidewall and a metal lower wall, wherein the depression is a cylindrical depression and wherein an interference fit is formed between an outer surface of the cylindrical metal sidewall of the canister and a cylindrical surface of the depression;

wherein the wall including the depression and the metal lower wall of the canister are coplanar.

8. The container of claim 7, wherein one of the plurality walls of the container is a cylindrical side wall having at least a portion thereof tapered.

9. The container of claim 7, wherein the depression includes at least one rib which interacts with the canister to hold the canister within the depression.

10. The container of claim 8, wherein one of the plurality walls of the container is a top can end joined to the cylindrical side wall of the container with a rolled joint.

11. The container of claim 10, wherein one of the plurality of walls of the container is a bottom can end joined to the cylindrical side wall of the container with a rolled joint, wherein the wall including the depression includes a substantially horizontal section extending between the rolled joint and the depression.

12. A container comprising:

a plurality of walls joined to form an enclosure which hermetically seals a contents of the enclosure within the walls, wherein one of the walls includes a depression extending into the contents of the enclosure, wherein the depression has a depth and a radius, wherein the depth is less than the radius; and a metal heating canister located at least partially within the depression, the heating canister having chemicals hermetically sealed therein and an activation structure configured to permit a user to cause the chemicals to change state to change the temperature of the heating canister, wherein the heating canister is sized relative to the depression such that the heating canister is held within the depression via an interference fit;

wherein the heating canister is a cylindrical metal canister including a metal upper wall, a cylindrical metal sidewall and a metal lower wall, wherein a diameter of the lower wall of the canister is less than a diameter of the wall including the depression, wherein the interference fit is formed between an outer surface of the cylindrical metal sidewall of the canister and a cylindrical surface of the depression;

wherein the wall including the depression and the metal lower wall of the canister are coplanar.

13. The container of claim 12, wherein one of the plurality walls of the container is a cylindrical side wall having at least a portion thereof tapered.

14. The container of claim 13, wherein the depression includes at least one rib which interacts with the canister to hold the canister within the depression.

15. The container of claim 13, wherein one of the plurality of walls of the container is a top can end joined to the cylindrical side wall of the container with a rolled joint.

16. The container of claim 15, wherein one of the plurality of walls of the container is a bottom can end joined to the cylindrical side wall of the container with a rolled joint.

17. The container of claim 12, wherein the activation structure is a portion of the canister deformable to permit the user to cause the chemicals therein to be pressed into contact with sufficient pressure to interact.

18. The container of claim 12, wherein the wall including the depression is joined to a sidewall of the container with a rolled joint, and the wall including the depression includes a substantially horizontal section extending between the rolled joint and the depression.

19. The container of claim 12, wherein an exterior surface of the wall including the depression and an exterior surface of a lower end of the heating canister are coplanar, wherein the heating canister has a height and radius, wherein the height is less than the radius.

20. A can end for a heated container comprising:

a periphery configured to be coupled to a side wall of a can creating a hermetic seal between the side wall and the can end;

a heating element;

an interior portion, the interior portion defining a depression extending upwardly, the depression having a depth and a diameter, wherein the depth is less than the diameter, wherein the depression receives and forms an interference fit with the heating element; and a substantially horizontal section extending between the periphery and the depression;

wherein the heating element includes a cylindrical metal canister including a metal upper wall, a cylindrical metal sidewall and a metal lower wall, wherein a diameter of the lower wall of the canister is less than a diameter defined by the periphery, wherein the depression is a cylindrical depression and wherein the interference fit is formed between an outer surface of the cylindrical metal sidewall of the canister and a cylindrical surface of the depression;

wherein the substantially horizontal section and the metal lower wall of the canister are coplanar.

21. The can end of claim 20, wherein the depression is shaped to match the heating element, wherein the depth of the depression is between 0.3 inches and 1.0 inches and the radius of the depression is between 0.75 inches and 1.5 inches.

* * * * *